United States Patent [19]

Bähr

[11] Patent Number: 5,059,321

[45] Date of Patent: Oct. 22, 1991

[54] DEVICE FOR EXPRESSING PLANT MATTER, PARTICULARLY FOR RE-PRESSING SUGAR-BEET CHIPS

[76] Inventor: Albert Bähr, Am Hungerberg 10, D-6682 Ottweiler 2, Fed. Rep. of Germany

[21] Appl. No.: 521,864

[22] Filed: May 11, 1990

[30] Foreign Application Priority Data

May 13, 1989 [DE] Fed. Rep. of Germany ..... 3915738
Apr. 23, 1990 [DE] Fed. Rep. of Germany ..... 4012920

[51] Int. Cl.[5] ..... B30B 9/24
[52] U.S. Cl. ..... 210/386; 210/401
[58] Field of Search ..... 100/218, 3, 258 A, 218, 100/269 R, 244, 264, 214, 219, 99, 222, 118–120; 210/386, 400, 401

[56] References Cited

U.S. PATENT DOCUMENTS 3,996,849 12/1976 Del Jiacco ..... 100/218

*Primary Examiner*—Frank Sever
*Attorney, Agent, or Firm*—Armstrong, Nikaido, Marmelstein, Kubovcik & Murray

[57] ABSTRACT

The invention relates to a device (1) for crushing plant matter, particularly for re-pressing sugar-beet chips. The matter to be pressed is distributed in thin layers of approximately 10 mm thickness on filter cloths (2) and is then subjected in a plurality of superposed plies (3, 4, 5, 6) to a high compressive pressure between a press platen (7) and a press crown (8). A loading device (10) is provided to deposit the matter to be pressed in layers on the filter cloth (2). The press platen (7) and the press crown (8) are essentially level, rectilinear and horizontal. The stack (25, 25') formed by the filter cloth (2) and the matter to be pressed is also fed rectilinearly and horizontally through the press opening (9, 9A) between the press planten (7) and the press crown (8).

41 Claims, 20 Drawing Sheets

DEVICE FOR EXPRESSING PLANT MATTER, PARTICULARLY FOR RE-PRESSING SUGAR-BEET CHIPS

The present invention relates to a device for expressing plant matter, particularly for re-pressing sugar-beet chips, in which the matter to be pressed is distributed in thin layers of approximately 10 mm thickness on filter cloths and is then subjected in a plurality of superposed plies to a high compressive pressure between a press platen and a press crown and in which a loading device is provided to spread the matter to be pressed in layers on the filter cloth.

During sugar production, sugar beet is generally washed and chopped, at which stage it has a dry matter content of the order of 5%. After the addition of hot water the sugar-beet chips which have been pre-treated in this way are further processed in an extraction tower, where the sugar-beet chips emerging from said extraction tower are initially regarded as a waste product with a dry matter content of the order of 10%.

During the standard process the pulped chips are then crushed in worm extruders where the filtrate from the crushing process is then re-cycled to the sugar production process. After leaving the worm extruders, the sugar-beet chips have a maximum dry matter content of approximately 25 to 28%.

A proportion of the beet chips processed in this way is used by farmers as silage chips and for cattle feed.

Since the sugar-beet chips cannot be kept in this form with their comparatively high moisture contents such chips are mostly dried to attain dry matter contents of approximately 90% by means of substantial heat input. In order to reduce energy costs during drying, there has been a move recently towards so-called low-temperature driers where waste heat from the sugar production process is used to dry the chips. In this, the chips are placed in layers on air-permeable filter belts which then pass through a plurality of stages of a low-temperature drier of this kind. During this process, warm air which is fed to the plant via large heat exchangers and large blowers is blown through the sugar-beet chips. This type of drying makes particular use of the residual waste heat fed to the cooling towers or cooling basins of a sugar factory, where this waste heat is extracted with a precondensation stage at as high a temperature level as possible. The use of such plant which serves to initially dry the chips before they are fed to the conventional rotary chip drier ensures that primary energy need then only be used for the residual drying, and thus the energy balance can be considerably improved. The sugar-beet chips can be dried to dry matter contents of about 30 to 45% using this type of plant.

Such plant is, however, exceedingly large with the buildings generally having a volume of the order of 10,000 $m^3$, i.e. buildings 36 m in total length, 16 m wide and approx. 19 m high. The initial investment involved is extremely high, and the energy consumption for the large hot-air blowers which are necessary is considerable.

The hot-air blowers require several thousand kilowatts of electrical energy. Since sugar factories usually generate their own electricity, the installed capacity is often insufficient, as a result of which further investment is necessary or else the electrical energy must be bought in.

Since it is known that low-pressure thermal treatment on belt driers to achieve dry matter contents of the order of 50% costs approximately 50 times as much as a purely mechanical pressing process to the same dry matter content, and since on the other hand it has been demonstrated experimentally that the dry matter content of sugar-beet chips cannot be improved to more than about 25 to 28% in worm extruders, a wide variety of experiments have been conducted in an attempt to increase the dry matter content of sugar-beet chips by static pressing [cf. DEZ Zuckerindustrie 112 (1987) No. 9, pp. 771–778; DEZ Zuckerindustrie 112 (1987) No. 10, pp. 868–872; DEZ Zuckerindustrie 112 (1987) No. 11, pp. 946–950; DEZ Zuckerindustrie 112 (1987) No. 12, pp. 1068–1073].

The result of these experiments and studies is that dry matter contents of the order of 50% can be achieved with mechanical crushing of sugar-beet chips if they are distributed in thin layers of the order of 10 mm on filter cloths, these layers are then stacked together and subsequently pressurised with a high static pressure of the order of 50 bar for a period of 11 to 12 minutes.

Based on this knowledge, a device as described in DEZ Zuckerindustrie 11 (1986) No. 3, pp. 243, 244 was developed and tested in trials. In this device of the prior art a filter belt is rolled onto a reel and then unrolled from one reel onto another during which the filter belt is uniformly covered with sugar-beet chips. The filled reel is then conveyed into a pressure chamber which is provided with a press membrane on its inner wall. The press membrane is then filled with water, and the sugar-beet chips are further crushed. Once this process has been completed, the reel is removed from the pressure chamber and unrolled onto the other reel again during which the crushed chips are scraped off. The loading and discharging processes for the chips are largely automated, although to date the automatic loading of the reel into and removal from the pressure chamber have yet to be solved. The filter belt is an approximately 250 m long belt made of a special fabric. Experiments have shown that only one fiftieth of the energy which would have to be used for conventional drying is required for this crushing process.

Since, however, the reels have to be pressed together from the initial external diameter to a substantially smaller diameter during the juice extraction process in the cylindrical chamber the pressure membrane is subjected to a considerable degree of stretching. The filter belts are also pressed together from a large diameter to a small diameter with the result that creases are inevitably formed. In order to keep both the stretching of the membrane and the deformation of the filter cloths within acceptable limits the capacity of this system is comparatively small despite the 250 m long filter belt, as a result of which even a moderately sized sugar factory requires a number of such machines in order to achieve the necessary capacities.

A modified version of this device of the prior art is described in DE-OS 3524544. This device of the prior art is also based on the principle of high-pressure crushing in thin layers. In this device of the prior art the filter cloth layers are stacked on top of each other in the form of concentric circles and pressed. During loading and unloading of the press the cloth is unrolled from and rolled onto, respectively, a conical drum which is simultaneously displaced radially inwards and outwards, respectively. This machine of the prior art, however, is also not satisfactory in respect both of the manufacture of the filter cloth used as a quasi continuous concentric ring or spiral and of the necessary design input.

Based on a device as defined in the introduction and also utilising the principle of high-pressure crushing in thin layers, it is the object of the present invention to improve the device in respect of the simplicity of the design and its efficiency.

This object is achieved in the invention essentially in that the press platen and the press crown are designed such that they are essentially flat, rectilinear and horizontal, and that the stack formed by the filter cloth and the matter to be pressed is also fed rectilinearly and horizontally through the press opening between the press platen and the press crown. This type of construction permits a simple, operationally safe and problem-free design of device with a high degree of efficiency.

Correspondingly, a preferred embodiment of the invention provides that for each ply an endless filter belt running intermittently in accordance with the press cycle is provided, and that a loading device is assigned to each filter belt.

In this regard it is particularly advantageous for the filter belts to be configured such that they run together in the same direction. This embodiment enables any desired number of 1 cm thick layers to be created with the simplest of means without any especially costly designs being necessary.

In a particularly preferred embodiment of the invention the press platen and the press crown are formed within an enclosed rigid frame, where the frame comprises an upper and a lower pressure beam and two tension rods linking the free ends of the pressure beams and maintaining a fixed distance between them, where the press platen or the press crown is formed by a pressure plate which is movable within the frame, and where the movable pressure plate can be pressurised by high-pressure generators within the enclosed frame. It is self-evident that with this embodiment, depending on the location and alignment of the movable pressure plate, one of the two pressure beams of the frame can form the press platen or the press crown. The particular advantage which is achieved overall with this embodiment is that the enclosed frame can absorb any pressure, as a result of which no particular heavy base or similar must be provided in order to absorb the considerable pressures involved which are of the order of 1,000 t or 100 kg/cm$^2$. Because the high-pressure generators create the pressure within the enclosed frame the pressure is uniformly and well distributed without bending stresses and, at the same time, a particularly economical construction is feasible.

An appropriate improvement in the invention also provides for the movable pressure plate to be formed as a hydraulic bed where a number of adjacent high-pressure generators are provided which are distributed over the length and/or width of the movable pressure plate. This feature permits the enormous pressures to be achieved with comparatively inexpensive high-pressure generators while the already mentioned feature of the avoidance of bending stresses is guaranteed in optimum fashion. The high-pressure generators which press the movable pressure plate in the form of a hydraulic bed in the direction of the press opening are preferably braced within the enclosed frame against one of the two pressure beams.

In particular it is preferred in this regard that the high-pressure generators be located in two contiguous parallel rows on the movable pressure plate, where depending on the width of the filter belts and consequently of the press opening six to twelve such high-pressure generators are provided in each row. If it is assumed that an area of approximately 200×200 mm can be pressurised per high-pressure generator it is self-evident that bending stresses can be completely avoided, as a result of which a correspondingly light design of movable pressure plate can be incorporated.

For cost reasons the high-pressure generators are in the form of single hydraulic cylinders.

An advantageous improvement to the invention provides for the movable pressure plate to be in the form of a box-shaped drawer into which the high-pressure generators are inserted. This permits a particularly economical form of mounting for the high-pressure generators to be achieved which offers the additional advantage that individual high-pressure generators can be replaced without difficulty in the case of malfunctions.

It is preferred that the movable pressure plate be mounted at both ends in lifting cylinders which can be actuated to open the press opening and retract the deactivated high-pressure generators. The lifting cylinders consequently serve to open the press and have simply to raise the weight of the movable pressure plate and the high-pressure generators located therein in the form of a drawer as soon as they are depressurised.

In an alternative embodiment the invention can be designed such that the press platen and the press crown are formed by at least one pair of pressure plates, where said pair comprises a rigidly mounted pressure plate and an opposed movable pressure plate, between which the stack of filter belts runs with the matter to be pressed contained between the belts, and that the pressure plates forming the pair are connected together by high-pressure generators located at their free ends to form an enclosed frame. This embodiment, like the embodiment described first, offers the advantage that no costly base or similar is required to absorb the pressure since this is absorbed within the frame formed by the high-pressure generators and the two pressure plates. Very high pressures can thus be achieved with the simplest of means.

It is particularly preferred in this regard that the press platen and the press crown be formed by a number of adjacently located frames. This design represents the most economical solution in that approximately 25 cm wide H-beams can be used as press plates to manufacture presses of any desired size.

It is preferred in detail that the filter belts forming the stack are tracked between their terminal zones in a rectilinear horizontal line in two stacks forming an upper strand and a counterrunning lower strand of the belt circuit.

In this embodiment it is particularly advantageous for two press openings then to be provided, one of which accommodates the stack on the upper strand and the other the stack on the lower strand. This makes it possible for two stacks to be pressed simultaneously, as a result of which a substantial saving in filter belts and also in space is achieved.

In the embodiment with two press opening it is particularly advantageous for a movable intermediate plate to be provided between the hydraulic bed forming the movable pressure plate and a second hydraulic bed located vertically beneath this forming a second movable pressure plate, for the intermediate plate to comprise a press surface on its upper face which forms the press platen of the upper press opening, and that the lower face of the intermediate plate forms the abutment for the high-pressure generators of the second hydraulic bed. This embodiment ensures that with the simplest of designs the considerable pressures generated can be transmitted in both press openings and yet at the same time can be absorbed by the frame formed by the upper and lower pressure beams and the tension rods connecting them.

It is advantageous in this regard for the intermediate plate to be provided with bores in two lateral extensions, where said bores are located in guides which can be displaced in sliding fashion on the tension rods which connect the upper and lower pressure beams. This makes it feasible for juice to be extracted from both parallel stacks consisting of filter belts and matter to be pressed in one and the same press within each press cycle without the design expense of a separate second press.

An improvement in the form of a modified embodiment which also comprises two press openings is possible in which a movable intermediate plate is provided between the upper movable pressure plate and the lower rigidly mounted pressure plate, where said intermediate plate comprises two press surfaces, one of which is located opposite the press surfaces of the upper movable pressure plate and the other opposite the press surfaces of the lower rigidly mounted pressure plate.

In particular, it is an advantageous feature of this embodiment that the high-pressure generators are in the form of double-action hydraulic cylinder units.

A particularly preferred embodiment can be provided in this connection by attaching the cylinder housing of the hydraulic cylinder units to the lower rigidly mounted pressure plate, and by connecting the piston rod of the hydraulic cylinder unit to the upper movable pressure plate.

In a particularly preferred embodiment the intermediate plate is provided with bores in two lateral extensions, where said bores are located in guides which can be displaced in sliding fashion on the piston rod and that a driver is attached to each piston rod, said driver being located below the bores. Here too this makes it feasible for juice to be extracted from both parallel stacks consisting of filter belts and matter to be pressed in one and the same press within each press cycle without the design expense of a complete second press.

It is preferred that a plate made of plastic or a similar material be attached to the press surfaces in order to protect the filter belts.

In an advantageous improvement to this feature the plates on the sides facing the stacks comprise open filtrate channels through which the filtrate can easily flow away laterally.

Further, a filtrate collection reservoir is advantageously provided under each stack.

It is advantageous that the filter belts which form the stacks be split into individual tracks via idlers or similar outside the press opening. This makes it possible to locate one loading device and one discharge unit in each of the tracks for each filter belt so that uniform loading of the individual filter belts is guaranteed.

In the embodiment in which the stacks are divided into two stacks running in opposite directions it is preferred that two loading devices and two discharge units be provided in each of the tracks for each filter belt.

Furthermore, at least one cleaning device is provided for the filter belts within each track.

In a particularly preferred embodiment each discharge unit is designed such that it comprises two idlers which run in opposed directions and at which two opposed filter belts of the stack are separated from each other, a brush roll is provided opposite each idler, where each filter belt is fed between an idler and a brush roll, and that the brush rolls are driven such that they are counterrotating relative to their respective idler. This type of design for the discharge unit ensures correct removal of material, particularly crushed sugarbeet chips, from the filter belts since this type of matter is particularly difficult to handle and comparatively sticky.

For this reason it is also preferred that a scraper be located on the idler in direct contact with the matter to be pressed.

In order to prolong the service life and to ensure proper removal of the crushed material it is also preferred that the bristles on the brush rolls be made of plastic and/or steel.

The invention can be improved particularly by locating the brush rolls below the track in a trough-like housing open at the top, and by providing a conveyor device for the crushed matter on the base of the housing. This offers an expedient means of combining the removal of the crushed material from the filter belts with the discharge in a space-saving design.

To this end, a screw conveyor is particularly appropriate as the conveyor device.

It is preferred that the loading device be designed to provide a uniform thickness throughout the layer of matter to be pressed when loading the individual filter belts.

Since this is extremely difficult to achieve with sugarbeet chips an advantageous improvement to the invention is provided in that the loading device comprises a screw conveyor which spans the full width of the filter belts, and that in the region of the underside of the housing of the screw conveyor a material outlet opening is provided which reaches across the full width of the filter belts.

To further equalise the layer of matter to be pressed once spread it is further particularly advantageous for a circulating rotary-driven drag ring to be provided on the outside of the housing of the screw conveyor, and for the direction of rotation of the scraper ring to be opposed to the direction of rotation of the feed screw of the screw conveyor. This ensures that the matter to be pressed is spread more evenly as it emerges from the material outlet opening of the screw conveyor.

An improvement to this design can advantageously be produced by providing the drag ring with a baffle housing which comprises a rectilinear feed edge over the full width of the filter belts. This ensures that the matter to be pressed which is transferred in small portions by the drag ring is further equalised.

It is particularly advantageous for the same purpose for the material outlet opening to be offset relative to the feed edge in the direction of rotation of the feed screw. As a result the part of the baffle housing between the material outlet opening and the feed edge forms as it were a surge store which ensures further equalisation of the thickness of the material layer.

In a particularly preferred embodiment a rotary-driven chamber wheel is located after the feed edge in the running direction of a filter belt where the direction of rotation of said chamber wheel is advantageously opposed to the running direction of the relevant filter belt. The combination of the above-described measures ensures that an absolutely uniformly distributed layer of matter to be pressed is achieved.

In a modified embodiment the loading devices are formed by a hopper, a chain slat conveyor or bucket conveyor and a feed chute.

In order to achieve as space-saving a design as possible it is preferred in this regard that at least part of the filter belts be fed outside the press opening between the upper strand and the lower strand of the bucket conveyor. This permits the entire device to be built rectilinearly, thereby avoiding costly designs involving directional changes for the filter belts.

The invention is described below in further detail with reference to embodiments illustrated by way of example in the drawings, in which.

Figure 1:
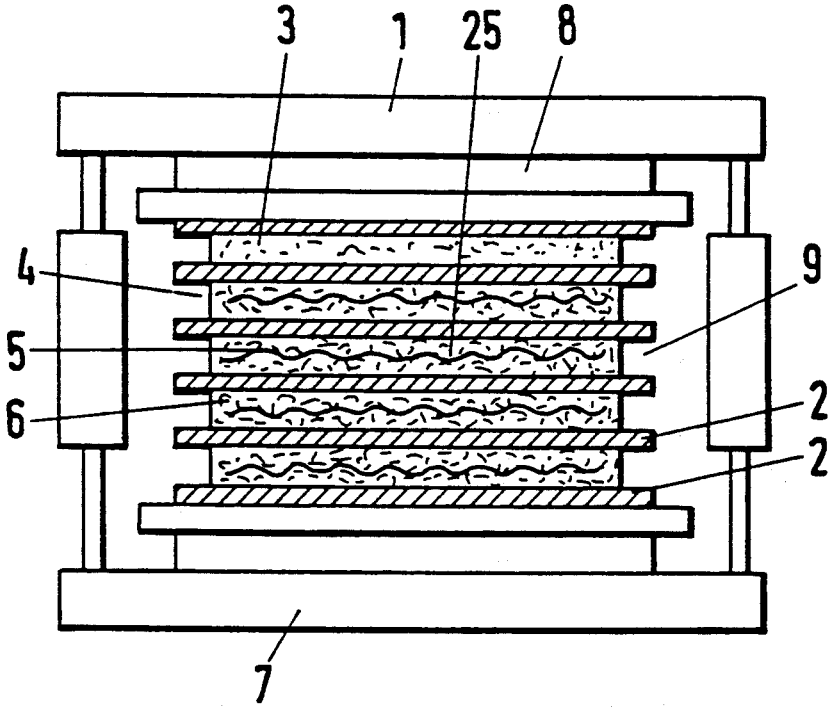
FIG. 1 shows a highly diagrammatic sectional view to illustrate the press process.

As indicated diagrammatically in FIG. 1, the device 1 whose details are shown in a first embodiment in FIGS. 2 to 11 and a second embodiment in FIGS. 12 to 23 serves to crush plant matter, in particular to re-press sugar-beet chips. As FIG. 1 shows, the matter to be pressed is deposited in thin layers of approximately 10 mm thickness on a filter cloth 2 and uniformly distributed. The plies 3, 4, 5, 6 formed by a filter cloth 2 and a layer of the matter to be pressed are stacked on top of each other and subjected to a high pressure between a press platen 7 and a press crown 8 in order to attain a dry matter content of the order of 50% as mentioned in the introduction.

As shown in detail in FIGS. 2 to 7, the particular feature of the illustrated embodiment of the device 1 according to the invention is that the press platen 7 and the press crown are designed such that they are flat and horizontal and form a straight line.

The stack formed by the superposed plies 3, 4, 5, 6 comprising the filter cloth and the matter to be pressed is also fed rectilinearly and horizontally through the press opening between the press platen 7 and the press crown 8 and there subjected to the static pressure within the press. As illustrated, an appropriate number of loading devices 10 are provided for each ply 3, 4, 5, 6.

Each of the plies 3, 4, 5, 6 comprises as its filter cloth 2 a circulating filter belt 11, 12, 13, 14, 15 where said filter belts 11 to 15 are closed and endless and run intermittently in accordance with the press cycle. A separate loading device 10 is assigned to each filter belt 11 to 15, as can be seen particularly in FIG. 2.

In this regard all the filter belts 11 to 15 are configured such that they run together in the same direction and come together to form the stack 25 in the region of the press opening 9.

Figure 5:
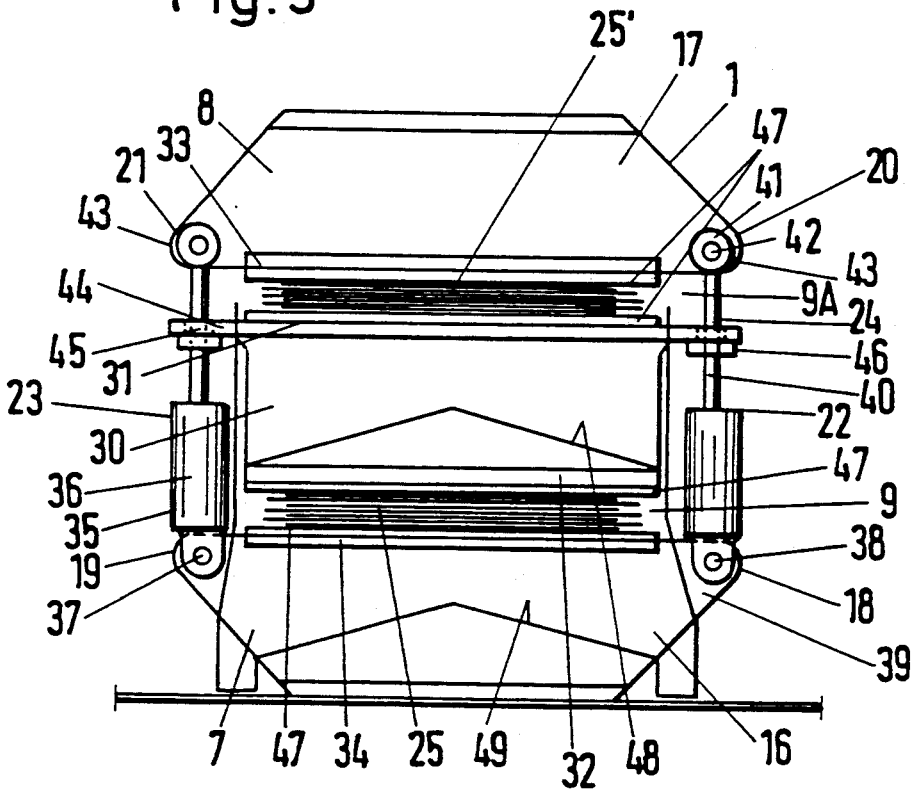
FIG. 5 shows a sectional view along the line V of FIG. 1.
Figure 6:
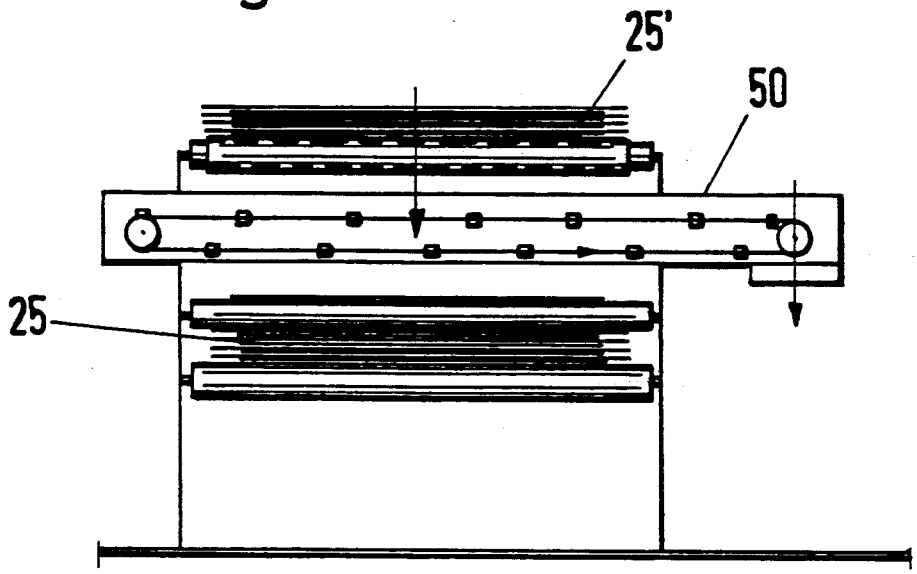
FIG. 6 shows a sectional view along the line VI of FIG. 1.

As can be seen particularly from the sectional view in FIG. 5 which shows the region of the press zone, the press platen 7 and the press crown 8 consist of pairs of pressure plates 16, 17 where each of the pairs comprises a rigidly mounted pressure plate 16 and a movable pressure plate 17 located opposite. The movable pressure plate 17 here is located above the rigidly mounted pressure plate 16. A series of adjacent parallel pressure plates 16 thus form the press platen 7, while a series of opposed pressure plates 17 located parallel to each other form the press crown, as indicated in FIG. 3.

The stack 25 comprising the filter belts 11, 12, 13, 14, 15 with the matter to be pressed contained between them runs through between the upper movable pressure plates 17 and the lower rigidly mounted pressure plates 16. Each of the pairs of movable and rigidly mounted pressure plates 16, 17 is connected by high-pressure generators 22, 23 to form an enclosed frame 24, as a result of which the entire press zone consists of a series of such frames 24 accommodating the filter belts 11 to 15 with the matter to be pressed.

The design is selected such that, as shown in FIG. 5, the high-pressure generator 22 connects the free end 18 of a rigidly mounted pressure plate 16 with the free end 20 of the superposed movable pressure plate 17. On the opposite side the high-pressure generator 23 connects the free end 19 of the rigidly mounted pressure plate 16 with the free end 21 of the movable pressure plate 17.

Figure 2:
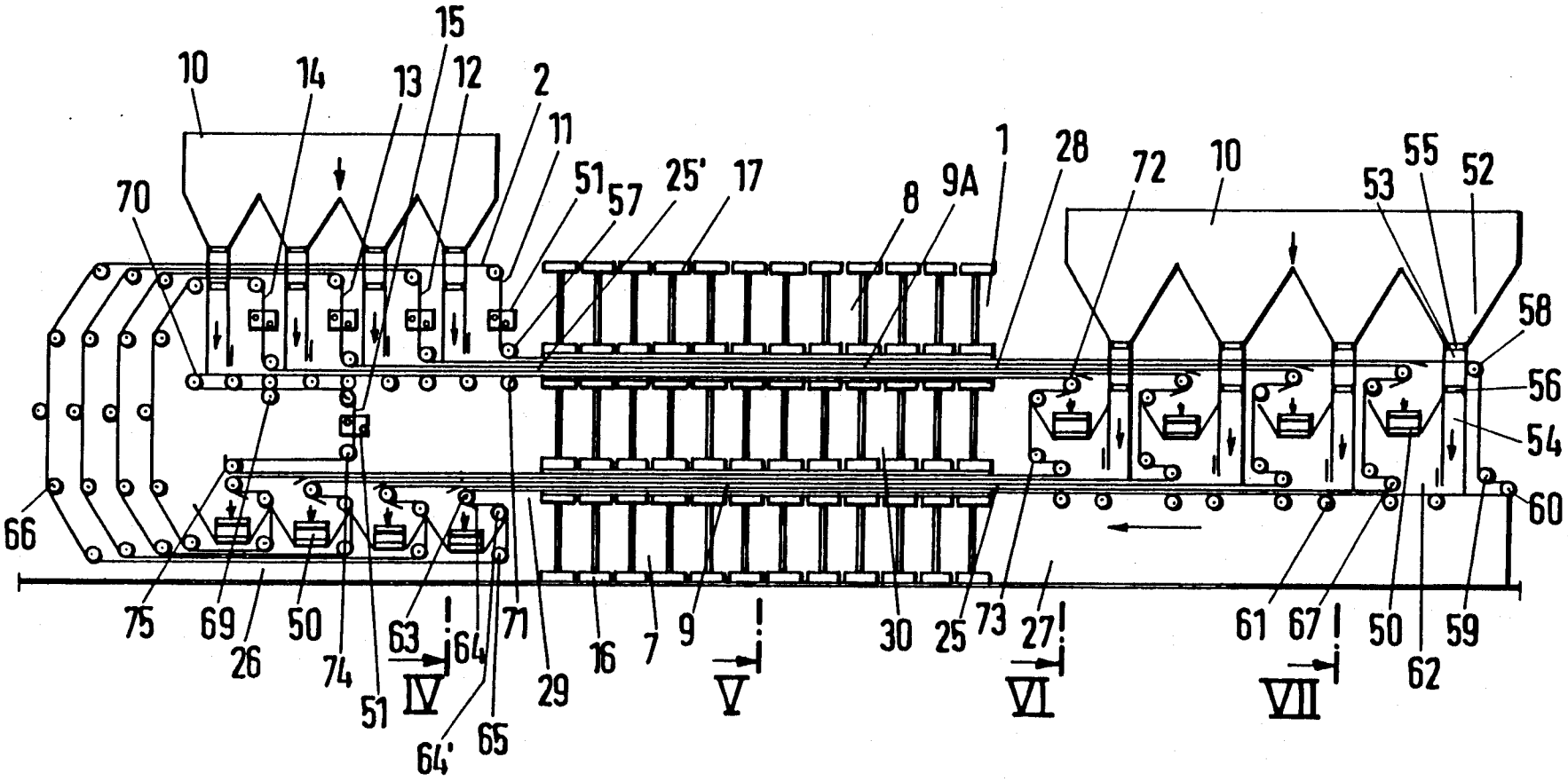
FIG. 2 shows a diagrammatic side view of an embodiment of the device according to the invention.
Figure 3:
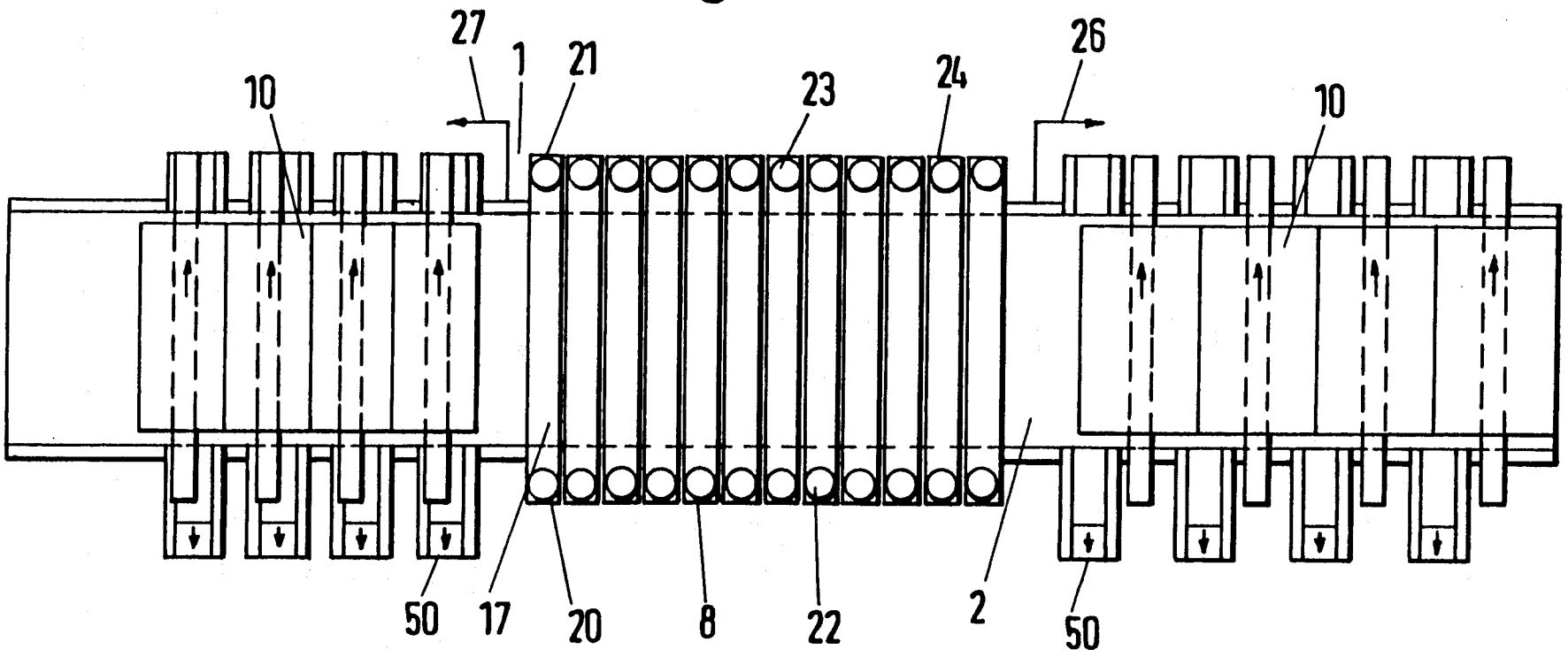
FIG. 3 shows a plan view of the device according to FIG. 2.

In the embodiment exemplified in FIGS. 1 to 11 the configuration is also selected such that the filter belts 11, 12, 13, 14, 15 forming the stack 25 are tracked between their terminal zones indicated in FIG. 3 by the arrows 26, 27 rectilinearly and horizontally in two stacks 25, 25' forming an upper strand 28 and a counter-running lower strand 29 of the belt circuit.

The press zone illustrated correspondingly comprises two press openings 9 and 9A, of which press opening 9 accommodates the stack 25 on the upper strand 28 and press opening 9A accommodates the stack 25' on the lower strand 29.

In order to press both stacks 25 and 25' simultaneously and using the same high-pressure generators 22, 23 a movable intermediate plate 30 is provided between the upper movable pressure plate 17 and the lower rigidly mounted pressure plate 16. The intermediate plate 30 comprises two opposed press surfaces 31, 32. The press surface 31 is located opposite the press surface 33 of the upper movable pressure plate 17, while the press surface 32 is located opposite the press surface 34 of the lower rigidly mounted pressure plate 16. Thus in the embodiment exemplified the press opening 9 is formed between the opposed press surfaces 32 and 34, while the supplementary press opening 9A is formed between the press surfaces 31, 33.

In the embodiment shown in FIGS. 1 to 11 the high-pressure generators 22, 23 are in the form of double-action hydraulic cylinder units 35. The cylinder housing 36 of the hydraulic cylinder units 35 is attached to the lower rigidly mounted pressure plate 16 via a lug 41 which is connected by means of a pin 38 to a lateral extension 39 of the lower pressure plate 16. The piston rod 40 of the hydraulic cylinder unit 35 is connected to the upper movable pressure plate 17 in that a lug 41 on the piston rod 40 is attached via a pin 42 to a lateral extension 43 of the upper press plate 17. The intermediate plate 30 is provided with bores 45 in two lateral extensions 44, where said bores are located in guides which can be displaced in sliding fashion on the piston rod 40. A driver 46 is attached to each piston rod 40 of the opposed hydraulic cylinder units 35 below the bores 45.

As a result of this configuration the force exerted during the pressing stroke by the hydraulic cylinder units 35 is transmitted by the upper movable pressure plate 17 via the stack 25' to the intermediate plate 30 and further on to the stack 25, such that both stacks 25, 25' are pressed together between the upper pressure plate 17 and the lower pressure plate 16 with the intermediate action of the intermediate plate 30.

Once the press process is complete the direction of motion of the hydraulic cylinder units 35 is reversed to open the press, for which initially the movable pressure plate 17 is raised from the upper stack 25'. Once the drivers 46 come into contact with the piston rods 40 on the underside of the lateral extensions 44, the intermediate plate 30 is then also raised from the stack 25, thereby allowing said stack to be conveyed out of the press zone once pressing is complete.

As can also be seen in FIG. 5, the preferred embodiment is characterised in that a plate 47 made of plastic or a similar material is attached to each of the opposed press surfaces 31, 32, 33, 34 in order to protect each of the outside filter belts 11 and 15 of the two stacks 25, 25'. It is preferred that the plates consist of a low-friction plastic since at least each lowest filter belt is advanced over these plates 47 as if over a skid plate during loading of the sugar-beet chips into the press and discharging of the crushed material from the press zone.

It is also preferred that the plates 47 on the sides facing the stacks 25, 25' comprise open filtrate channels (not shown) through which the extracted juice can be removed. As further indicated in FIG. 5, a filtrate collection reservoir 48 or 49 is provided under each of the stacks 25, 25' in the press zone, where said reservoir collects and removes the juice which is pressed laterally and vertically from the stacks 25, 25'.

As illustrated in FIG. 2, the filter belts 11, 12, 13, 14, 15 which form the stacks 25, 25' are split into individual tracks via a number of idlers or similar, partially described below, outside the press opening 9, 9A.

One loading device 10 and one discharge unit 50 are provided in each of the tracks for each of the filter belts 11, 12, 13, 14, 15. In the case of the embodiment exemplified in the drawing, in which the area between the two terminal zones 26, 27 is used twice for crushing the sugar-beet chips, each of the tracks comprises two loading devices 10 and, correspondingly, two discharge units 50. A cleaning device 51 is also provided in each of the tracks for each of the filter belts 11, 12, 13, 14, 15 preferably directly before each concomitant loading device 10, within which cleaning device the relevant filter belt is cleaned by means of compressed air or similar.

Figure 4:
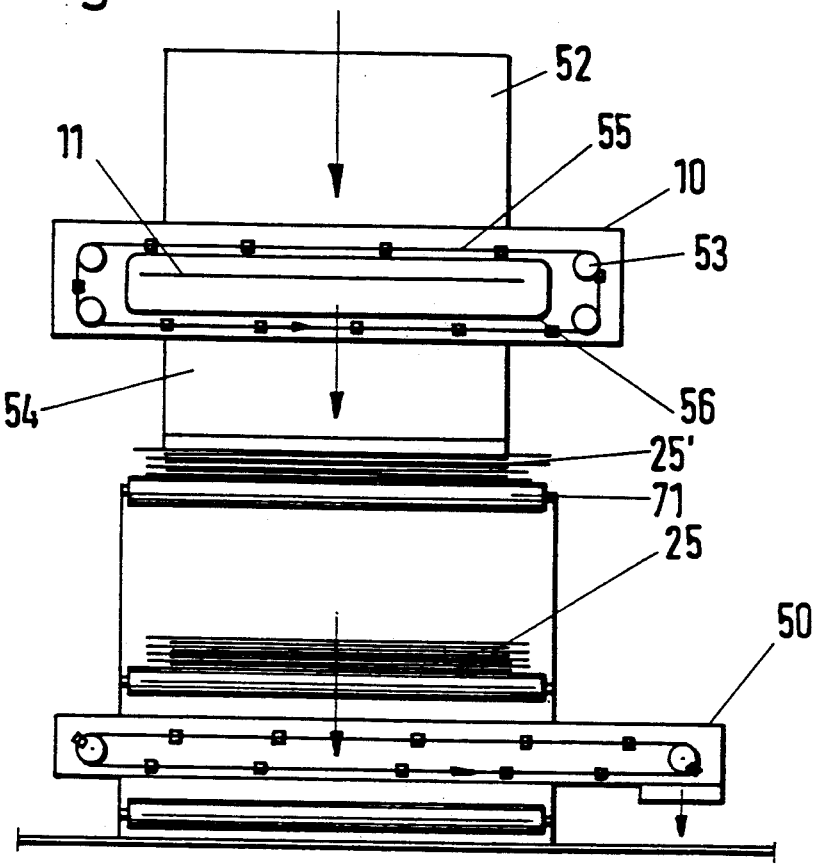
FIG. 4 shows a sectional view along the line IV of FIG. 1.
Figure 7:
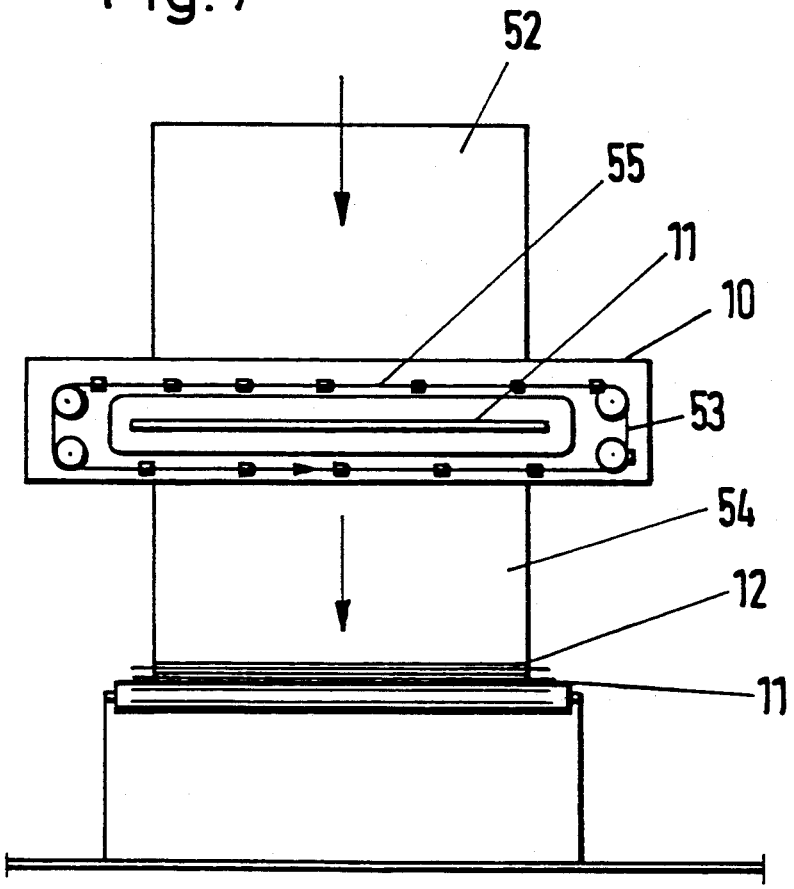
FIG. 7 shows a sectional view along the line VII of FIG. 1.
Figure 8:
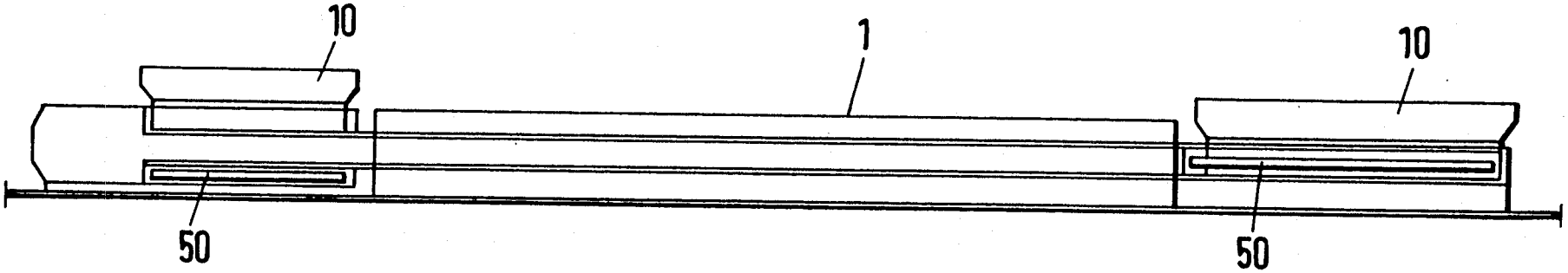
FIG. 8 shows a diagrammatic side view of a device according to the invention in a design for practical operation.

As can be seen in particular in FIGS. 4 and 7, each of the loading devices 10 in the embodiment exemplified consists of a hopper 52 which comprises at its lower end a chain slat conveyor or bucket conveyor 53. The chain slat conveyor or bucket conveyor 53 transports material to a feed chute 54, by means of which the sugar-beet chips are distributed in a uniform layer across the width of each relevant filter belt.

In order to achieve a rectilinear and as space-saving a design as possible the filter belts 11, 12, 13 and 14 are fed outside the press opening 9, 9A through the loading devices 10 and run between the upper strand 55 and the lower strand 56 of the relevant bucket conveyors.

Although all the filter belts 11, 12, 13, 14, 15 are moved simultaneously and at the same speed between the press cycles, the route of each individual filter belt is described below through the configuration illustrated in FIG. 2 such that the route for all the filter belts together can be understood.

It is assumed that the starting point for the filter belt 11 is at the cleaning device 51 in the upper left half of FIG. 2. Exiting downwards from the cleaning device 51, the filter belt 11 runs around an idler 57 into the press opening 9A and from there in a straight line again until the right-hand end of the device 1 to a further idler 58. Between the end of the press opening 9A and the idler 58 the filter belt 11 is tracked between the upper strand 55 and the lower strand 56 of the bucket conveyors 53 which belong to the loading devices for the filter belts 11, 12, 13, 14 and 15 and which in conjunction with the latter form the stack 25 which enters the press opening 9.

After the idler 58, the filter belt 11 is tracked downwards over further rollers 59 and 60, where said roller 60 diverts the filter belt 11 into a horizontal section. In this horizontal section the filter belt 11 is supported by a number of rollers 61. Directly after the roller 60 the feed chute 54 of the loading device 10 assigned to the filter belt 11 merges towards the belt, and thus after this point a thin layer of sugar-beet chips is deposited on the filter belt 11.

As further indicated in FIG. 2, each of the feed chutes 54 is provided with a device 62 to regulate the thickness of the layer of sugar-beet chips deposited, said device being explained in greater detail below with reference to FIG. 24. After exiting from the press opening 9, the filter belt runs around a discharge roller 63 where a scraper blade 64 or similar is provided and where at this point the crushed sugar-beet chips are discharged into the diagrammatically represented conveyor of the discharge unit 50.

After the discharge unit 50, the filter belt 11 is then returned via idlers 64', 65 to the upper left end of the device 1 from where it runs between the upper strand 55 and the lower strand 56 of the bucket conveyors 53 of the loading devices 10 assigned to the press opening 9A and then passes over another idler 66 back into the cleaning device 51.

As far as the filter belt 12 is concerned, it is assumed that the starting point for this belt too is at the cleaning device 51 in the upper left half of FIG. 2.

After exiting from the cleaning device, the filter belt 12 is returned to a horizontal direction around an idler corresponding to the idler 57. The sugar-beet chips are deposited after this idler. At the idler 57 of the filter belt 11, said belt runs onto the layer of sugar-beet chips located on the filter belt 12. The filter belt 12 runs through the press opening 9A and from there horizontally through the loading devices 10 assigned to the press opening 9A. After leaving the third loading device a discharge roller 66 with a scraper blade is provided, by means of which the sugar-beet chips crushed in the press opening 9A are passed to the discharge unit 50.

After leaving the discharge unit the filter belt 12 is tracked over further rollers and around an idler 67 to return it to a horizontal direction, where directly after the idler 67 the feed chute 54 of the loading device 10 assigned to the press opening 9 merges with the filter belt 12. The filter belt 12 at the idler 67 has simultaneously contacted the layer of sugar-beet chips located on the filter belt 11.

The filter belt 21 then passes through the press opening 9 and then after the press opening is in turn tracked around a discharge roller 68 from where the crushed sugar-beet chips are transferred to the discharge unit 50.

After the discharge unit 50, the filter belt 12 is then returned via the rollers 65 to the upper left end of the device according to FIG. 2, from where it runs horizontally through the three left loading devices 10 and re-enters the cleaning device 51.

The route of the filter belts 13 and 14 is analogous to the route described immediately above and can undoubtedly be followed on the basis of the above description.

As far as the filter belt 15 is concerned, from the starting point in the cleaning device 51 in the left half of FIG. 1 said belt first runs over the illustrated rollers 69 and 70 into a horizontal section in which the filter belt 15 is supported by a number of rollers 71 which in this section also successively support the remaining filter belts. After the filter belt has passed around the roller 70 a layer of sugar-beet chips is deposited by the feed chute which merges with the belt at this point, after which the filter belt 14 contacts this layer.

After exiting from the press opening 9A the filter belt 15 runs around a discharge roller 72 with a scraper blade or similar from where the crushed matter passes to the discharge unit 50.

After the discharge unit 50, the filter belt is returned over a number of rollers 73 to a horizontal section in which the filter belt 15 contacts the layer of sugar-beet chips conveyed on the filter belt 14 prior to the press opening 9. After exiting from the press opening 9 the filter belt 15 is tracked via idlers 74 and 75 back to the cleaning device 51.

The device as described is operated in cyclical fashion in accordance with the press cycle in the press zone. Assuming a press cycle has just ended, the hydraulic cylinder units 35 in the entire press zone are first depressurised and their direction of motion is reversed, as a result of which both press openings 9 and 9A are opened. Thereafter all the filter belts 11, 12, 13, 14, 15 are advanced simultaneously and in the same direction by an amount equivalent to the length of the press opening 9 and 9A, at the same time as which sugar-beet chips are deposited by the loading devices 10 in the desired layer thicknesses on each of the conveyor belts both to the left and right of the press zone and at the same time as which in the region of the discharge units 50 assigned to the individual filter belts the previously crushed sugar-beet chips are passed to the discharge unit. Then, once the filter belts have been braked and the loading devices have ceased work, the press is closed again, and the press cycle can begin.

The embodiment illustrated in FIGS. 2 to 7 represents a size of design which is suitable for experimental purposes and fairly small quantities. The embodiment illustrated has a total length of approximately 13 m and a total height of approximately 3.50 m, with the filter belts being approximately 2 m wide and the actual press zone being 4 m in length.

Figure 9:
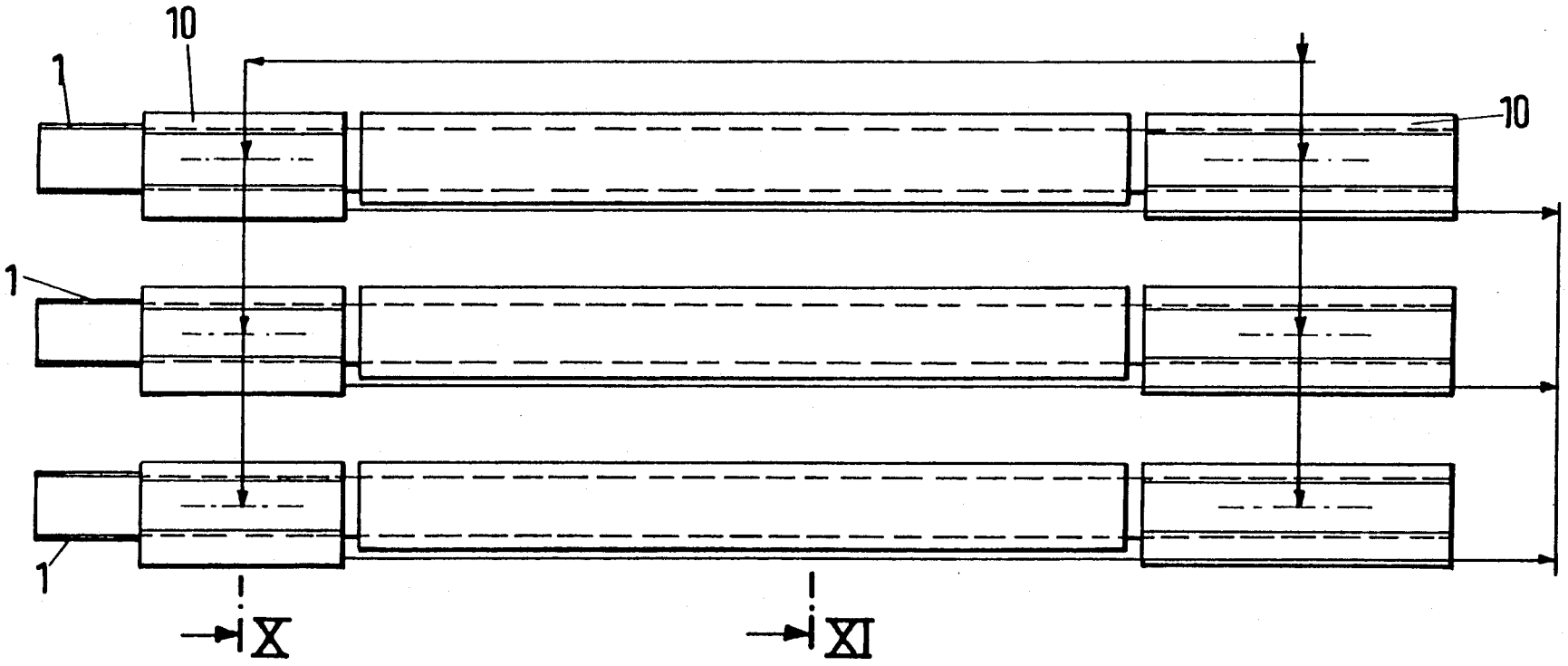
FIG. 9 shows a plan view of the device according to FIG. 8.
Figure 10:
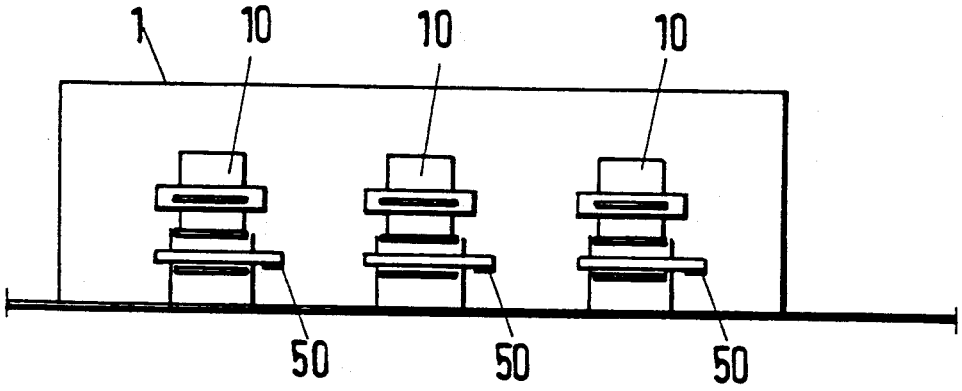
FIG. 10 shows a sectional view along the line X of FIG. 9.
Figure 11:
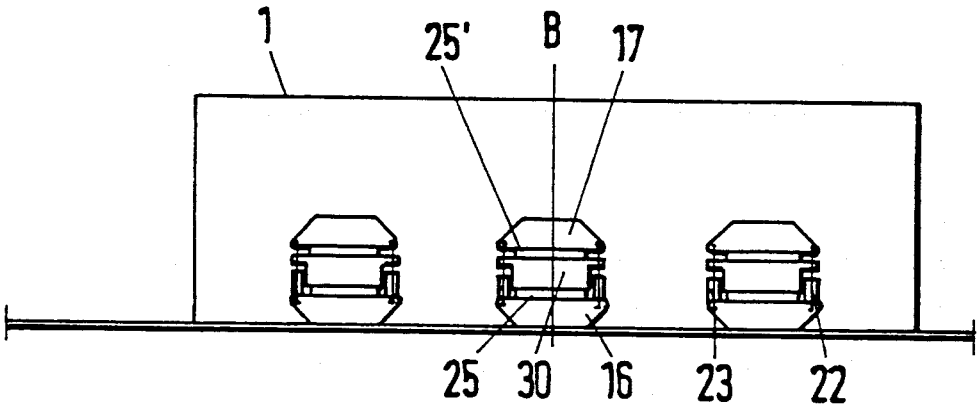
FIG. 11 shows a sectional view along the line XI of FIG. 9.

In FIGS. 9 to 11 a sketch of a device 1 is shown for the sake of completeness in a size as appropriate for practical operations during the sugar campaign. The embodiment illustrated comprises three parallel units where each unit has a total length of approximately 46 m with a press zone measuring approximately 25 m.

The particularly preferred embodiment of the invention as illustrated in detail in FIGS. 12 to 23 is described below.

Inasfar as the same components or components having the same effect are represented in FIGS. 12 to 23 in respect of this embodiment, the same designations have been used as in the first embodiment, as a result of which reference can be made to the above description where as no design modifications exist. Furthermore, the operational sequence in the preferred embodiment is the same as the operational sequence of the first embodiment described, and consequently here too reference can be made to the above description.

The essential difference in the embodiment illustrated in FIGS. 12 to 23 lies in a different design for the press area which represents a substantially cheaper alternative by comparison with the first embodiment.

It may be pointed out that pressures of approximately 1,000 t or 100 kg/cm$^2$ are produced per pressure beam, and thus it is evident to one skilled in the art that one of the high-pressure generators utilised in the first embodiment has a market price of approximately DM 50,000.

In order to provide other advantages while additionally reducing the cost of the high-pressure zone the embodiment illustrated particularly in FIGS. 12 to 17 incorporates the press platen 7 and the press crown 8 within an enclosed rigid frame 80. The rigid frame 80 consists of an upper pressure beam 81 and a lower pressure beam 82 together with two tension rods 85 and 86 of circular cross-section for reasons explained in greater detail below which link the free ends 83 and 84 of the two pressure beams 81 and 82 and maintain them at a fixed distance apart.

Figure 16:
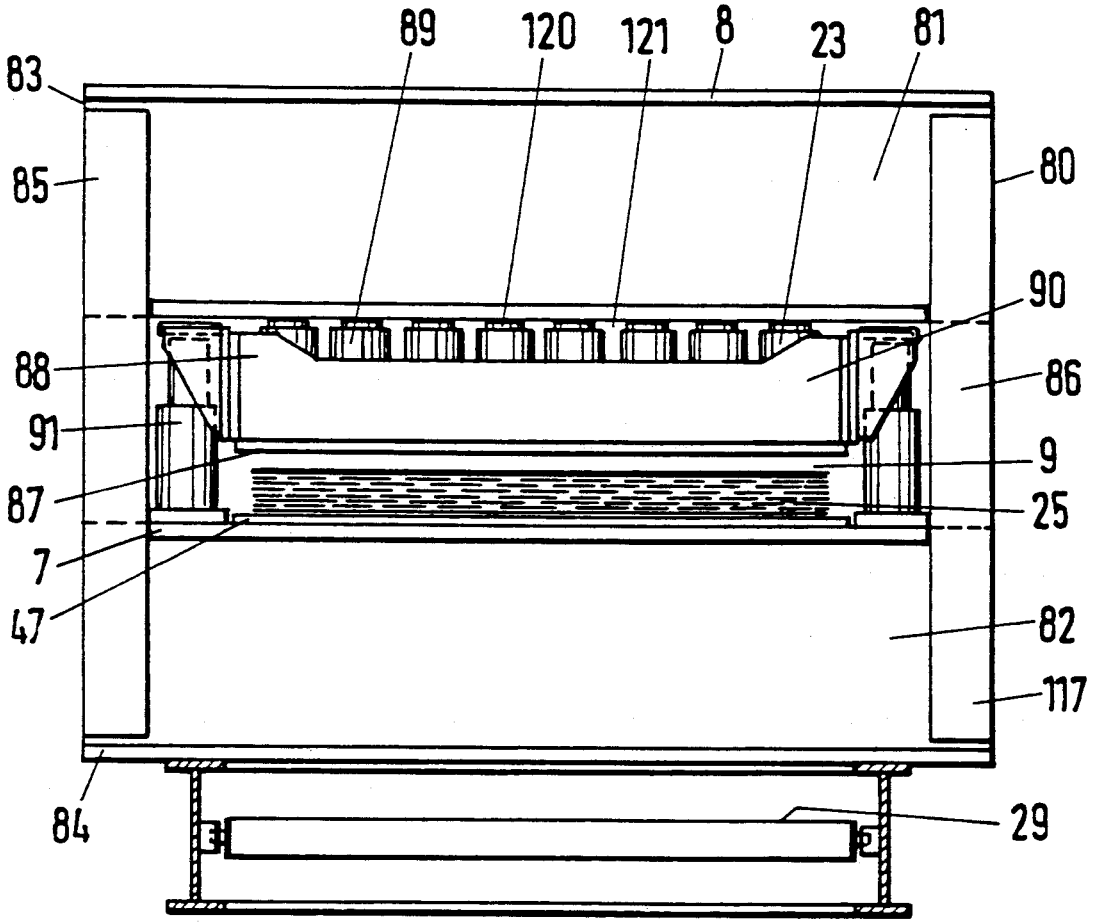
FIG. 16 shows a sectional view along the line XVI—XVI in FIG. 12 on an enlarged scale.
Figure 17:
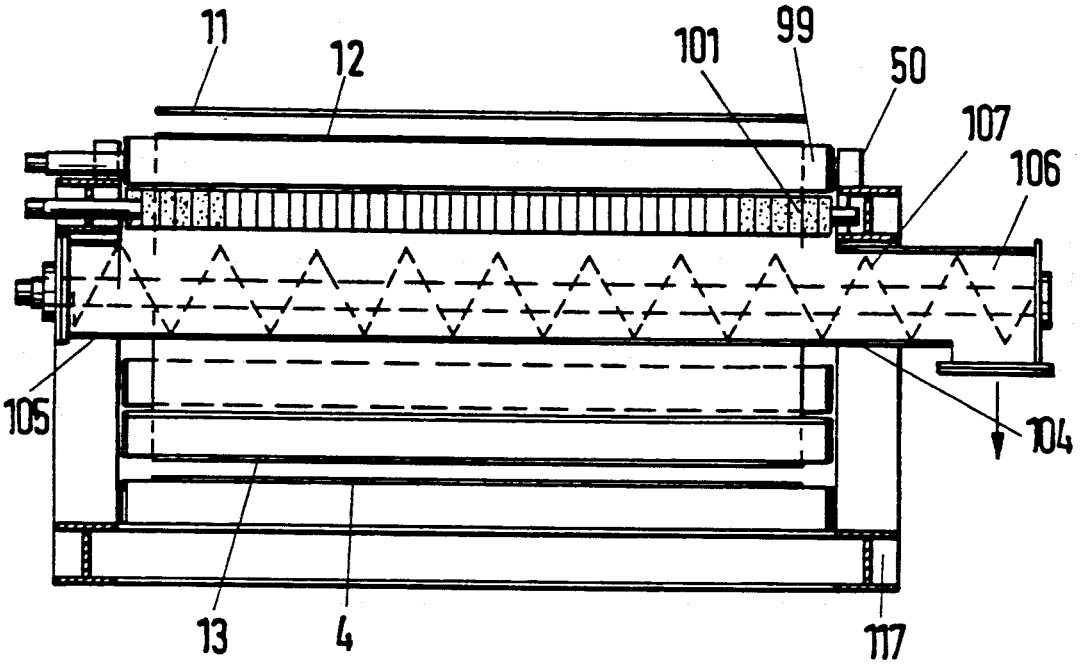
FIG. 17 shows a sectional view along the line XVII—XVII in FIG. 12 on an enlarged scale.

As can be seen particularly from the sectional view in FIG. 16, the press crown 8 here is formed by a pressure plate 87 which is movable within the frame 80 and can also be pressurised within the frame directly by high-pressure generators designated 23 overall.

It is self-evident that the configuration can also be selected such that the movable pressure plate 87 forms the press platen 7 and, in contrast to the representation as per FIG. 16, is raised towards the press crown 8, such that the underside of the upper pressure beam 81 forms the press surface opposite the press platen 7 formed by the movable pressure plate 87.

In the embodiment illustrated in FIGS. 12 to 17 the press platen 7 is formed by the upper face of the lower pressure beam 82 on which the stack of filter belts 11, 12, 13, 14, 15 and the matter to be pressed which is contained between them is moved through the press opening 9 on the plate 47 made of plastic or a similar material.

As FIG. 16 shows, the movable pressure plate 87 is in the form of a hydraulic bed 88 in that a number of high-pressure generators 23 are provided which are distributed in directly adjacent parallel rows over the length and width of the movable pressure plate 87.

In this configuration, in accordance with the width of the filter belts and consequently of the press opening 9, it is possible for example for two adjacent parallel rows of high-pressure generators 23 to be provided per movable pressure plate where six to twelve such high-pressure generators 23 are provided in each row.

As FIG. 16 shows, the high-pressure generators 23 in the preferred embodiment are in the form of single hydraulic cylinders 89 which are directly braced against the upper pressure beam 81.

It is self-evident that as a result of the configuration of the hydraulic cylinders 89 distributed in adjacent fashion over the surface of the movable pressure plate 87, where said cylinders each cover a pressure area of 200×200 mm, an extremely uniform pressure distribution can be achieved in which the movable pressure plate 87 is subjected to no bending stresses whatever. Consequently, the movable pressure plate 87 can be of a lightweight and simple design.

Figure 12:
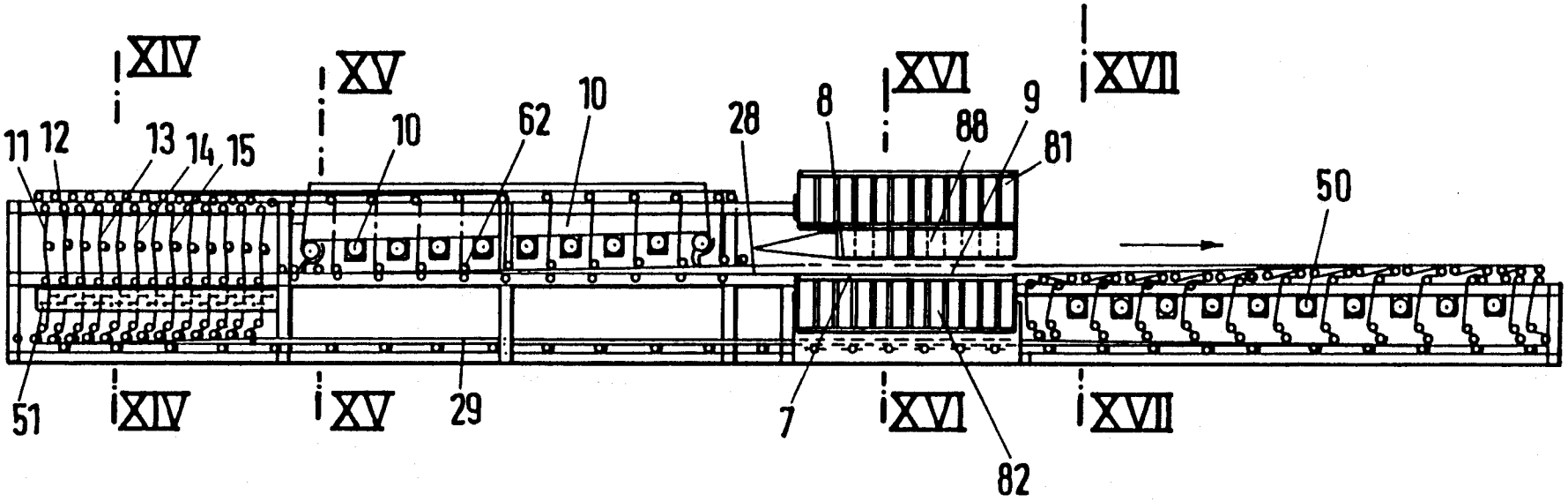
FIG. 12 shows a side view corresponding to FIG. 2 of a particularly preferred embodiment of the invention.
Figure 13:
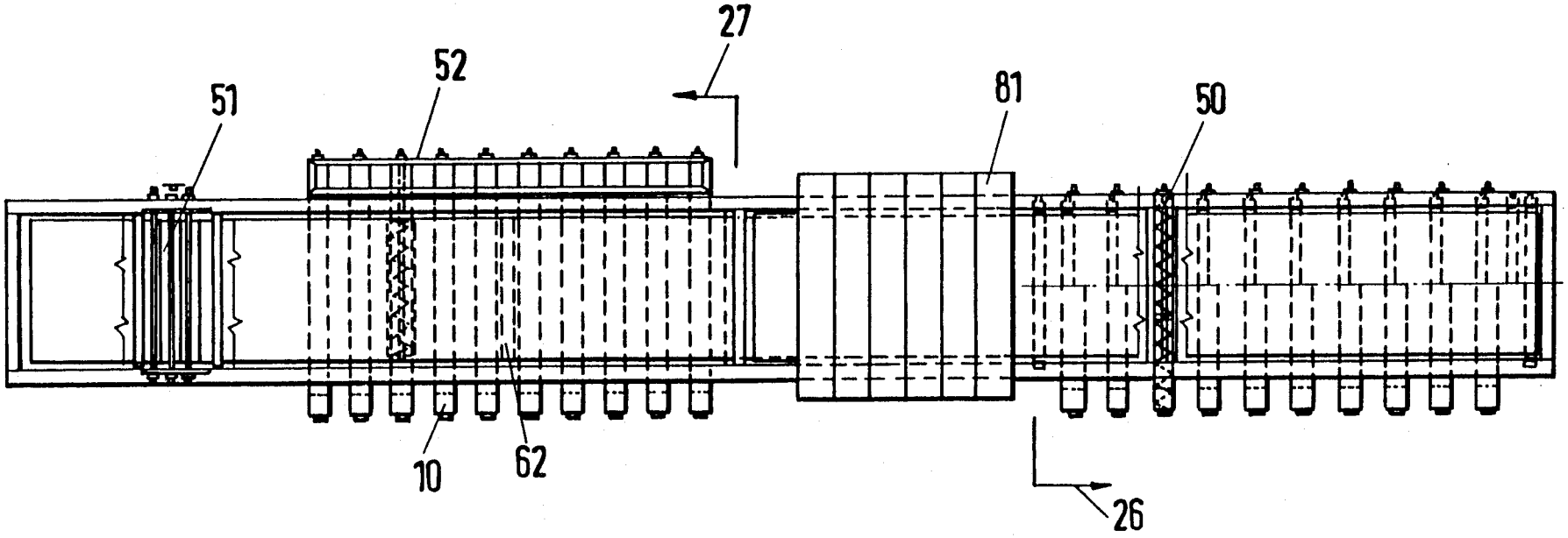
FIG. 13 shows a partially open plan view of the device according to FIG. 12.
Figure 14:
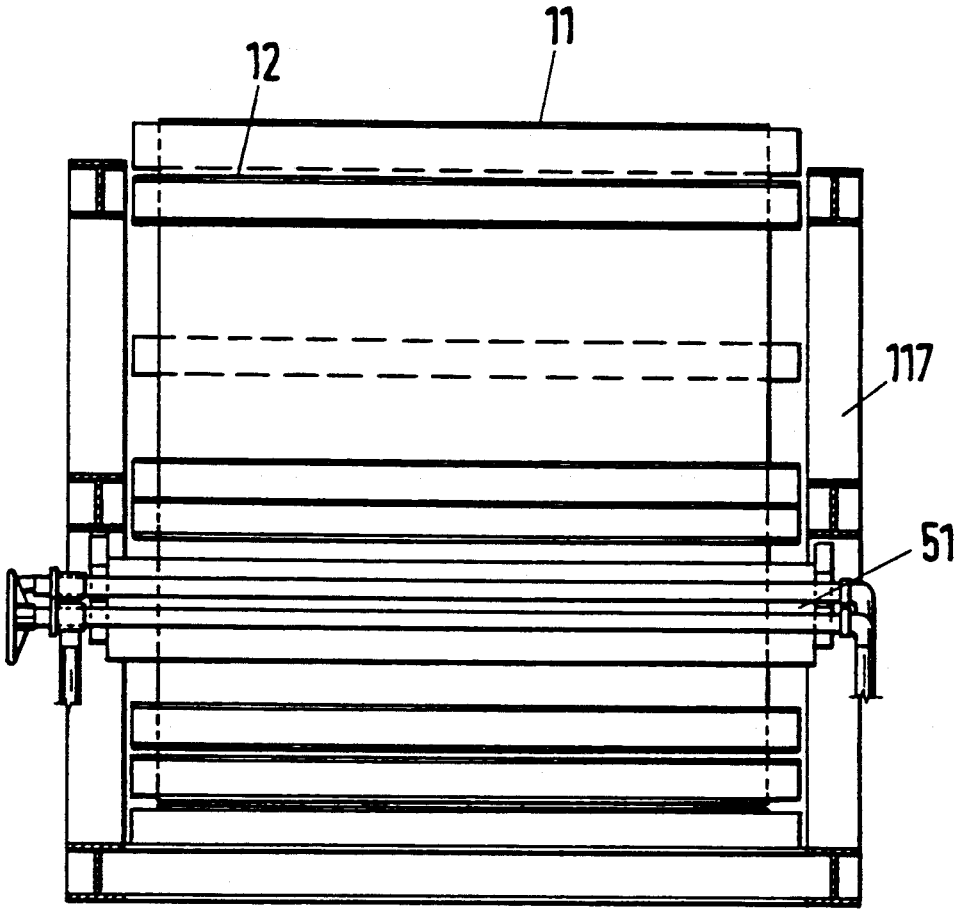
FIG. 14 shows a sectional view along the line XIV—XIV in FIG. 12 on an enlarged scale.
Figure 15:
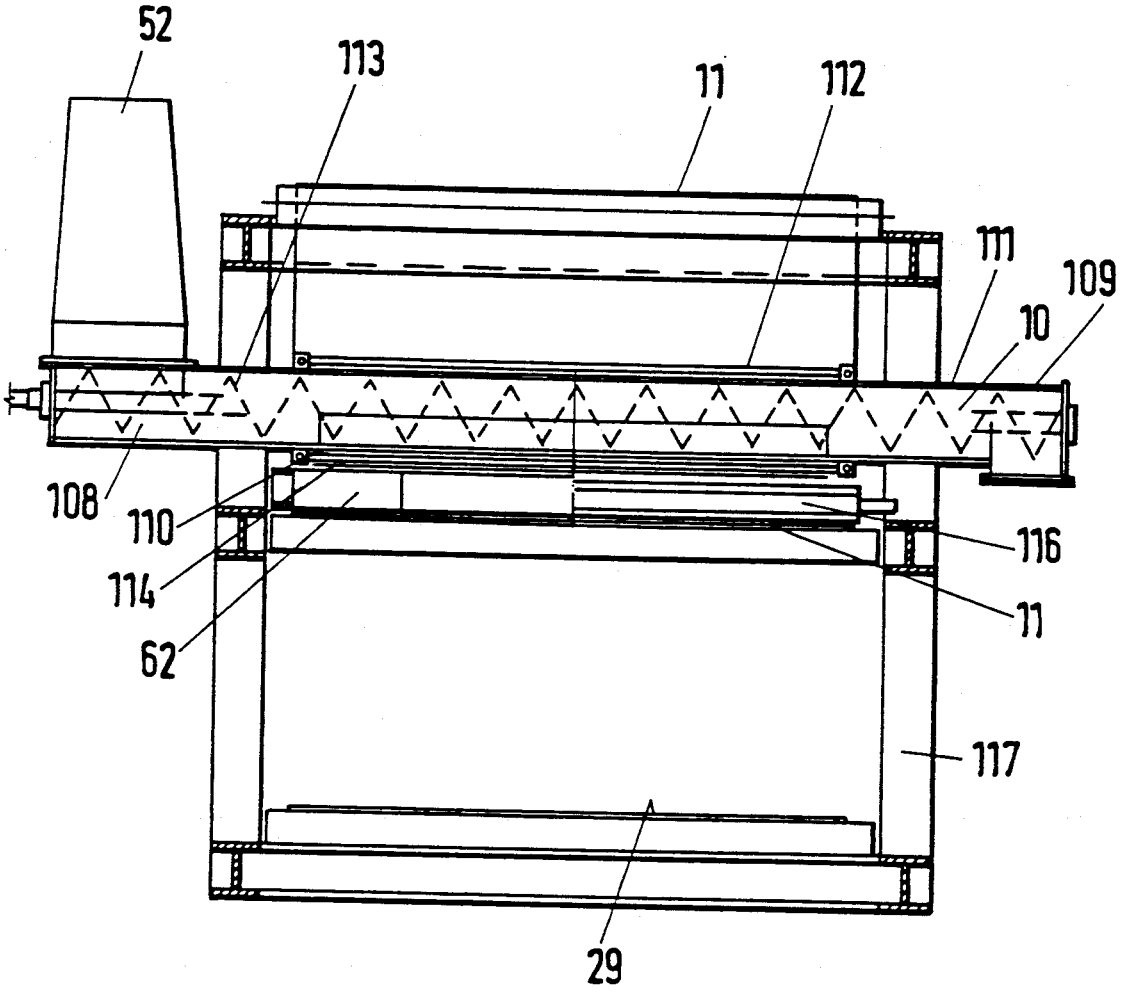
FIG. 15 shows a sectional view along the line XV—XV in FIG. 12 on an enlarged scale.

If it is assumed that the press region of the device 1 illustrated in FIG. 12 comprises a total of five rigid frames 80, the press region can be constructed using 100 such single hydraulic cylinders 89 which at a unit cost of approximately DM 1,000 amounts to a total cost of DM 100,000. In comparison with the hydraulic cylinder units 35 used in the first embodiment which would represent a cost factor of DM 100,000 per frame, and since two such hydraulic cylinder units 35 are provided per frame, this design results in a substantial cost saving.

As can also be seen in FIG. 16 (cf. also FIGS. 18 and 21), the movable pressure plate 87 in the form of a box-shaped drawer 90 into which the single cylinders 89 are inserted is of a comparatively lightweight design.

In the embodiment according to FIG. 16 the movable pressure plate is mounted at both ends in lifting cylinders 91 which can be actuated to open the press opening 9.

With the embodiment according to FIG. 16 the lifting cylinders 91 are located next to the plate 47 on the press platen 7 of the lower pressure beam 82, and two lateral brackets 119 of the movable pressure plate 87 rest on their piston rods 118.

When the lifting cylinders 91 are extended the movable pressure plate 87 is thus raised to open the press opening 9, while at the same time the piston rods 120 of the single hydraulic cylinders 89 which are braced directly on the underside 121 of the upper pressure beam 81 are retracted since the single hydraulic cylinders 89 are depressurised in this operational mode.

For re-pressing, for example, sugar-beet chips with the embodiment according to FIGS. 1 to 11 the stack 25 formed by the superposed plies 3, 4, 5 and 6 of the filter cloth and the matter to be pressed is advanced horizontally and rectilinearly into the press opening 9 after which the lifting cylinders 91 are depressurised. Then the static pressure is created in the press zone formed by the adjacent frames 80 in that all the single hydraulic cylinders 89 are pressurised, and the stack 25 is compressed between the movable pressure plates 87 of the adjacent frames 80 and the upper faces of the lower pressure beams 82 which form the press platen 7.

Once the press process is complete, the pressure in all the single hydraulic cylinders 89 is deactivated, and the lifting cylinders 91 are actuated in all the frames 80 to open the press opening 9, as a result of which the pressed section of the stack 25 can be moved out of the press zone by advancing the filter belts 11, 12, 13, 14, 15 and simultaneously an as yet unpressed section of the stack can be advanced into the press zone, during which the lowest filter belt slides over the plates 47 made of a low-friction plastic on the upper face of the lower pressure beams 82.

Figure 18:
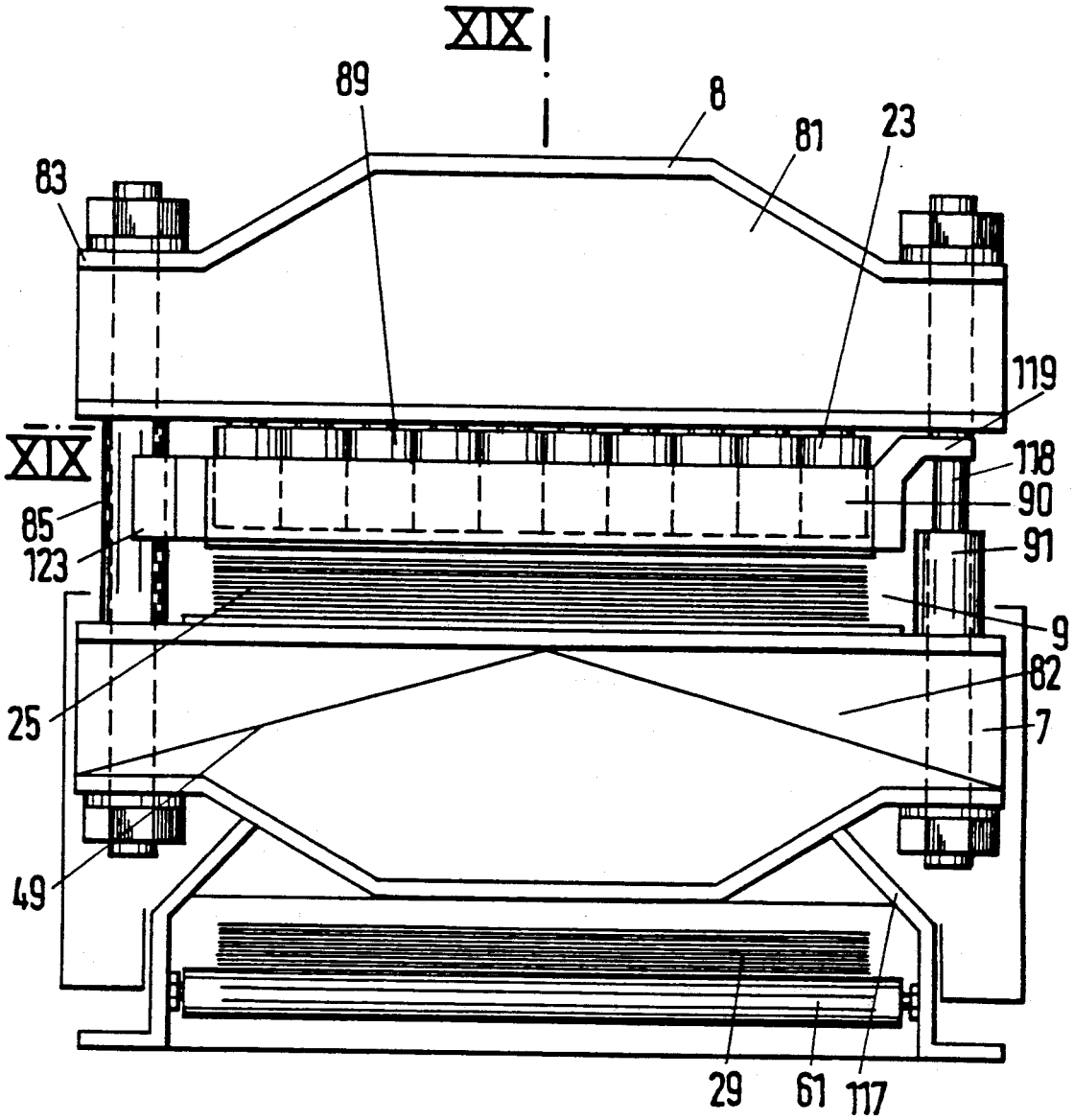
FIG. 18 shows a sectional view corresponding to FIG. 16 of an embodiment modified in respect of the configuration of the lifting cylinders.
Figure 19:
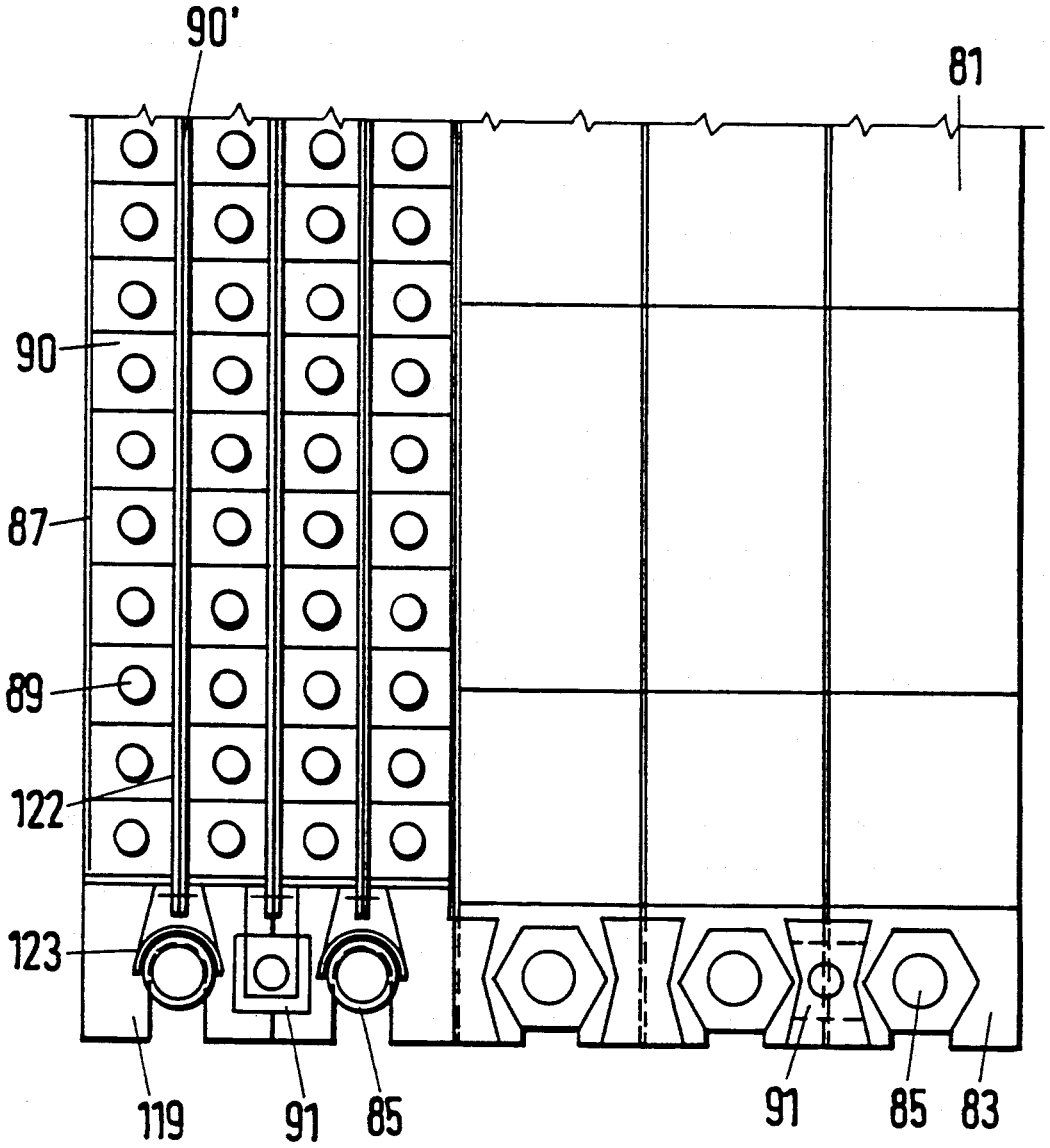
FIG. 19 shows a plan view partially in section along the line XIX—XIX in FIG. 18 of the embodiment according to FIG. 18.
Figure 20:
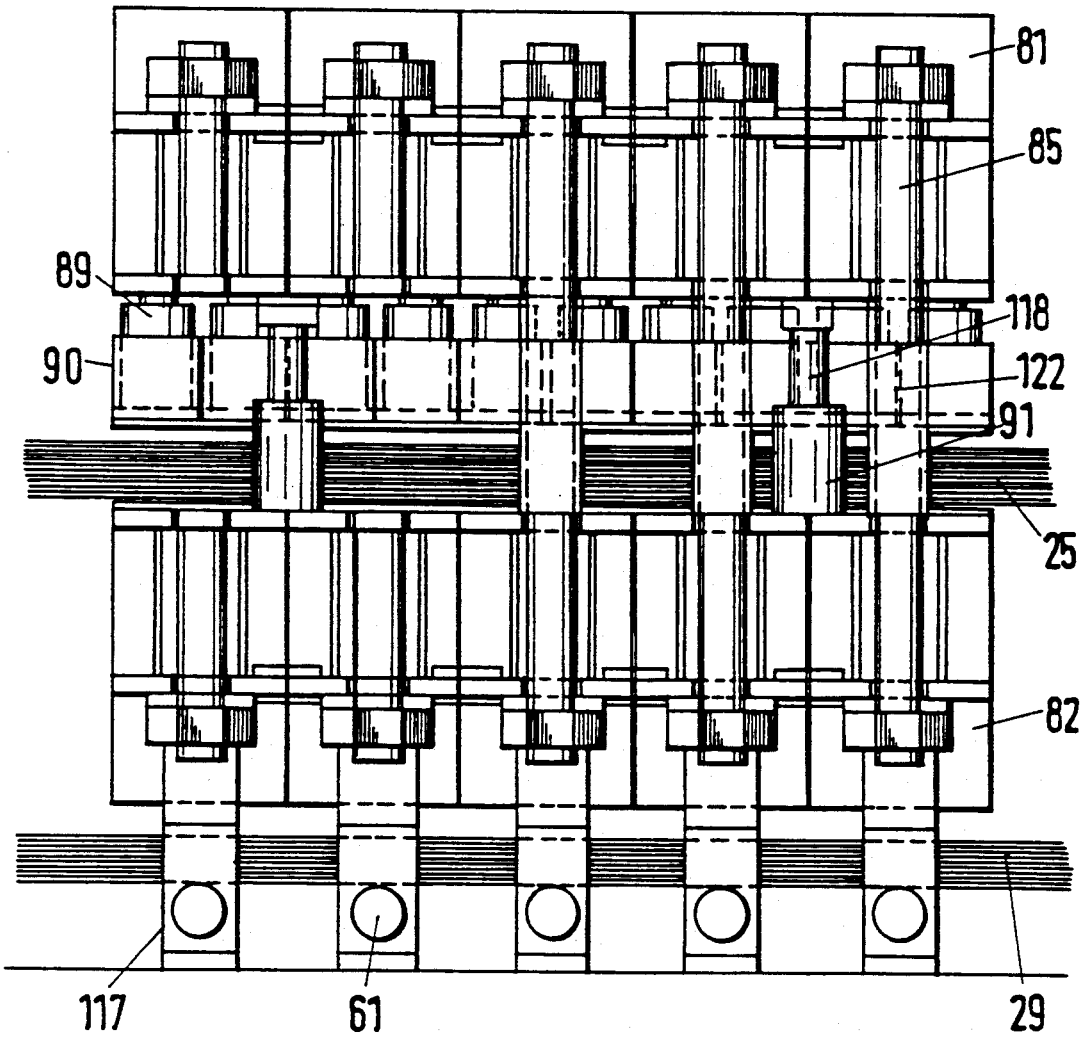
FIG. 20 shows a side view of the embodiment according to FIGS. 18 and 19.

In FIGS. 18 to 20 the views mentioned show a modification to the press zone which differs from the embodiment illustrated in FIG. 16 in respect of the mounting of the hydraulic bed, i.e. of the box-shaped drawer 90 which forms the movable pressure plate 87.

As shown, each of the movable pressure plates 87 in this embodiment consists of two box-shaped drawers 90 with single hydraulic cylinder units 89 located therein, where the drawers 90 are attached to each other along their adjacent side walls 122 within the brackets 119 by means of bolts or similar.

As can be seen in particular in FIG. 19, guides 123 which are approximately hemispherical in section are provided on two adjacent brackets 119 of a pair of drawers 90 where said guides 123 slide on the sides of the tension rods 85, 86 facing the press opening.

The next pair of drawers 90 of the adjacent movable pressure plate 87 is also connected along the side walls 122 with the pair of drawers 90 of the adjacent pressure plate 87, and it is in this area, i.e. between two adjacent guides 123 that the lifting cylinders 91 act. This design permits the number of lifting cylinders 91 to be restricted and at the same time it ensures that the movable pressure plate 87 is properly guided. The entire hydraulic bed 88 of the press opening 9 with all the adjacent rigid frames 80 is also moved as a single unit.

Figure 21:
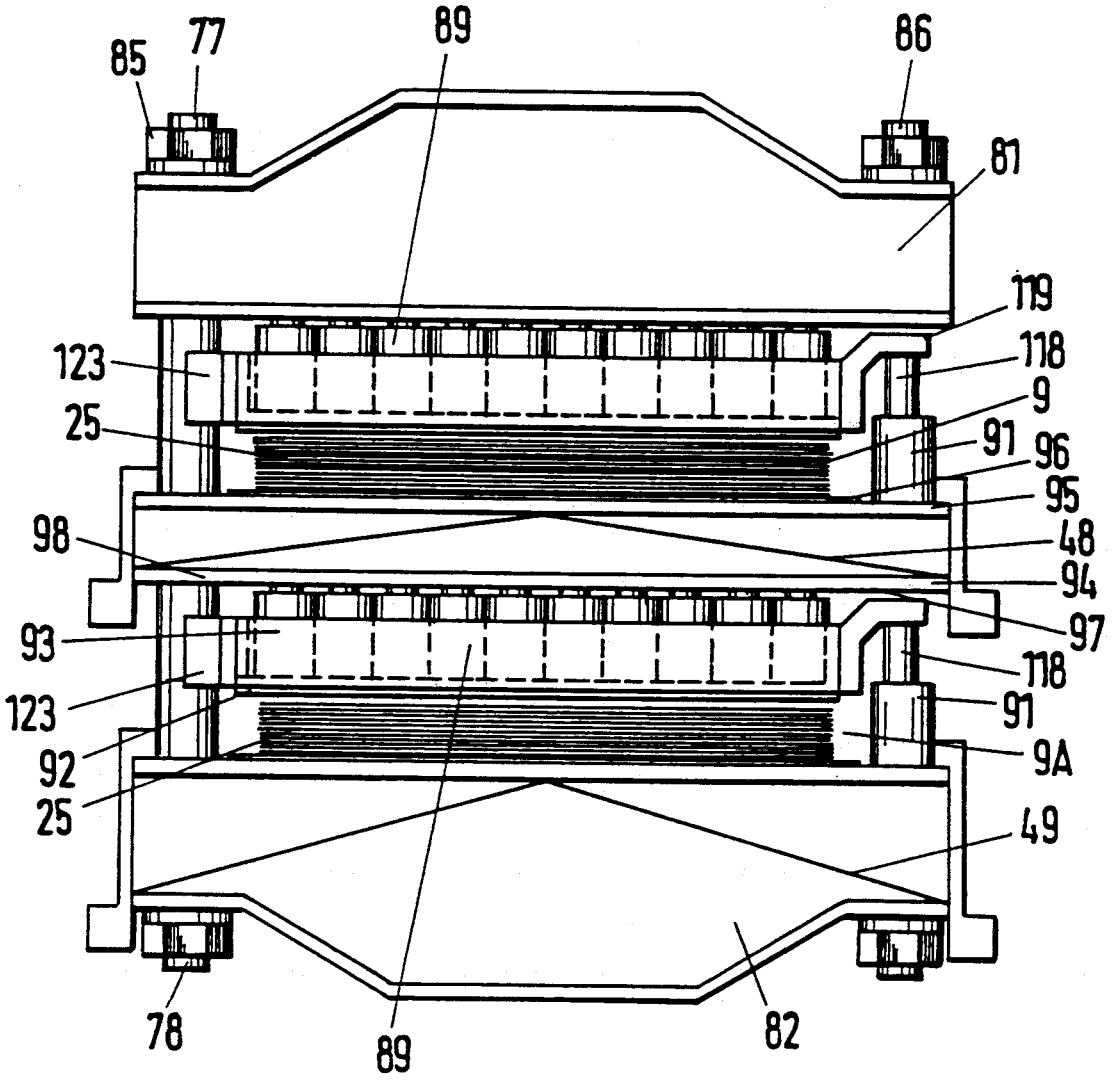
FIG. 21 shows a sectional view corresponding to FIG. 18 of an embodiment with two press openings.

FIG. 21 shows an embodiment corresponding in its design details essentially to the embodiment according to FIG. 18 in which two press openings 9, 9A are provided where the operational method of the embodiment corresponds to the operational method of the embodiment according to FIGS. 2 to 5, as a result of which reference can be made to the description of this first embodiment.

As shown, a movable intermediate plate 94 is provided in this embodiment between the hydraulic bed forming the movable pressure plate 87 of the first press opening 9 and a second hydraulic bed 93 located vertically beneath this forming a second movable pressure plate 92. The intermediate plate 94 comprises a press surface 96 on its upper face 95 which forms the press platen 7 of the first press opening 9.

The lower face 97 of the intermediate plate 94 forms the abutment 98 for the single hydraulic cylinders 89 of the second hydraulic bed 93.

The intermediate plate 94 is provided with two lateral extensions 76 which accommodate the tension rods 85, 86 in bores (not shown) are guided in sliding fashion on the latter.

As in the other embodiments, the tension rods 85, 86 are connected by nuts 79 or similar at their upper ends 77 and their lower ends 78 to the two pressure beams 81 and 82 which accommodate the tension rods 85, 86 in bores which are not shown. This type of configuration permits certain fundamental settings in respect of the size of the frames to be made.

As in the embodiment according to FIG. 5, pressing operations are conducted simultaneously in the press zones of both press openings 9 and 9A in the embodiment according to FIG. 21. In this regard, the press opening 9 accommodates the stack 25 on the upper strand 28, and the press opening 9A accommodates the stack 25' on the lower strand 29.

In order to press both stacks 25, 25' simultaneously the single hydraulic cylinders 89 of the two hydraulic beds 88 and 93 are pressurised simultaneously, in which process pressure is built up evenly in both press openings 9 and 9A because of the displaceability of the intermediate plate 94 on the tension rods 85 and 86. The lifting cylinders 91 relating to each hydraulic bed 88 and 93 are actuated to open the press opening 9 and 9A once the press process is complete, where the lifting cylinder 91 which belongs to the second hydraulic bed 93 moves the second hydraulic bed 93 against the intermediate plate 94.

Figure 22:
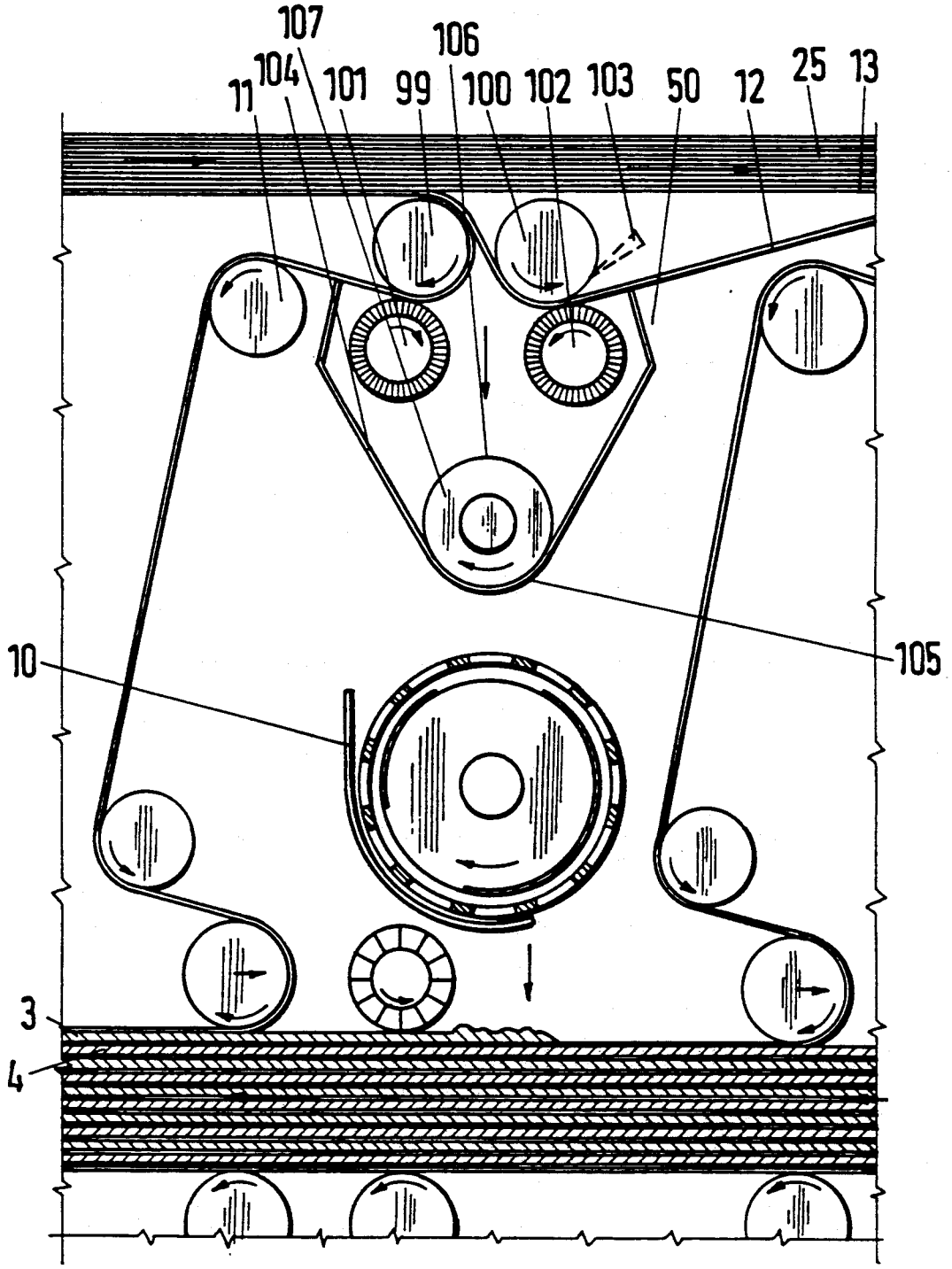
FIG. 22 shows a diagrammatic lateral sectional representation of the discharge region and feed region in the preferred embodiment according to FIGS. 12 ff.

FIG. 22 illustrates a lateral sectional view of a particularly preferred embodiment of the discharge unit 50 as assigned to each of the filter belts 11, 12, 13, 14, 15 and at the same time a particularly preferred embodiment of the loading device 10 is shown underneath, though this is explained in detail with reference to FIG. 23. The embodiment of the discharge unit 50 and the loading device 10 is also diagrammatically represented in FIGS. 12, 13 and 15, but can also be used in the embodiment according to FIGS. 1 to 11.

The preferred embodiment of the discharge unit shown in FIG. 22 is specially adapted to the particular characteristics of sugar-beet chips which are to be crushed since this material is particularly difficult to remove from the filter surfaces.

As shown, each discharge unit 50 comprises two idlers 99, 100 which are driven in counterrotating directions. The filter belts assigned to each discharge unit 50 (filter belts 11 and 12 in the representation shown in FIG. 22) which lie opposed to each other in the stack 25 and accommodate the crushed matter between them are separated from each other at the idlers 99, 100 in the illustrated manner with maximum wrap at the first idler 99 such that the intermediate layer of crushed material is broken up. At the same time one of the filter belts is diverted from the superposed stack 25 and routed around the idler 100.

Opposite each of the idlers 99, 100 is a brush roll 101 and 102 where the filter belt 11 is fed between the idler 99 and the brush roll 101, and the filter belt 12 runs between the idler 100 and the brush roll 102.

The brush rolls 101 and 102 are driven such that they are counterrotating relative to their respective idlers 99 and 100 and consequently also counterrotating relative to the direction of motion of the filter belts 11 and 12.

In the position illustrated, the idler 100 comes into direct contact with the crushed matter which is possibly adhering to the filter belt 12 since it was contained as a layer between the filter belts 12 and 13. In order to avoid the crushed matter sticking to the surface of the idler 100, a scraper 103 is located on each idler which comes into direct contact in this way with the crushed matter, where said scraper deposits any adhering crushed matter on the upper face of the filter belt which is advanced to the next discharge unit 50.

The bristles of the brush rolls 101, 102 are preferably made of plastic and/or steel in order to ensure thorough removal of the crushed matter from the filter belts.

As shown, the brush rolls are located at the open upper end of a trough-like housing 104 below the track of the filter belts 11 and 12, such that the material removed by the brush rolls 101, 102 is collected in the housing 104.

A conveyor device designated 106 overall is provided on the base 105 of the housing 104 for the crushed matter, for which the preferred embodiment utilises a screw conveyor 107 which is particularly suitable for conveying crushed sugar-beet chips.

Figure 23:
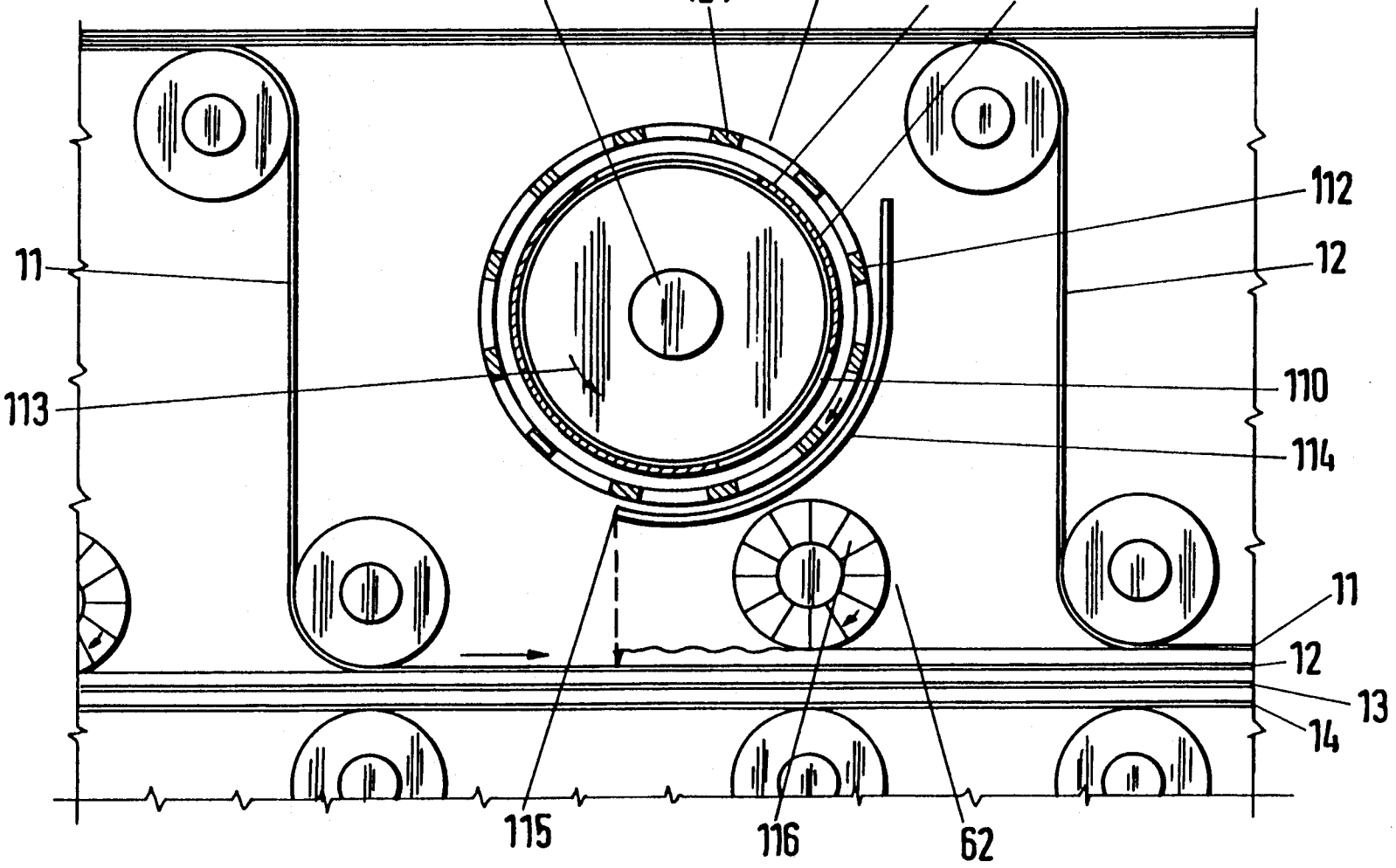
FIG. 23 shows a sectional representation corresponding to FIG. 22 in which the feed region for the matter to be pressed is illustrated on an enlarged scale for two filter belts of a stack.

The particularly preferred embodiment of the loading device 10 as illustrated in detail in FIG. 23, where said loading device is combined with the device 62 for regulating the thickness of the material layer, is also particularly suitable for sugar-beet chips since this material is extremely difficult to distribute uniformly in the required thin layers of 10 mm thickness. The loading device 10 in conjunction with the device 62 for regulating the thickness of the material layer is designed to provide a uniform thickness throughout the layer of matter to be pressed in the light of the design features described in further detail below.

To this end the loading device 10 as assigned to each of the filter belts 11, 12, 13, 14, 15 comprises a screw conveyor 108 which spans the full width of the filter belts.

In the region of the underside of the housing 109 of the screw conveyor 108 a material outlet opening 110 is provided which reaches across the full width of the filter belts 11, 12, 13, 14, 15.

A circulating rotary-driven drag ring 112 is provided on the outside 111 of the housing 109, where the direction of rotation of the drag ring 112 is opposed to the direction of rotation of the feed screw 113 of the screw conveyor 108.

The drag ring 112 itself is provided with a semi-dish-shaped baffle housing 114 which comprises a straight feed edge 115 over the full width of the filter belts 11, 12, 13, 14, 15.

As shown, the material outlet opening 110 of the housing 109 of the screw conveyor 108 is offset in the direction of rotation of the feed screw 113 relative to the feed edge 115 such that, because of the route to be covered in the baffle housing 114, a certain buffer action is achieved in respect of the material flow of the matter to be pressed as it emerges from the material outlet opening 110 over the feed edge 115 and onto the filter belt located beneath.

As can be seen in FIG. 23, the matter to be crushed is still deposited in slightly corrugated fashion onto the filter belt 12 as a function of the frequency with which the drag bar 124 of the drag ring 112 runs over the feed edge 115.

In order to equalise this corrugated deposit it is preferred that the device 62 be in the form of a rotary-driven chamber wheel 116 which also spans the full width of the filter belts 11, 12, 13, 14, 15.

The chamber wheel 116 is located after the feed edge 115 in the running direction of each filter belt 11, 12, 13, 14, 15, and in order to increase the relative speed the direction of rotation of the chamber wheel 116 is opposed to the running direction of the relevant filter belt 11, 12, 13, 14, 15.

Notice is hereby expressly given that the fundamental object of the invention is already solved by a device which only works with one press opening 9 in which the filter belts 11, 12, 13, 14, 15 pass the loading devices 10, of which correspondingly there is only one set, and are then returned to the entrance of the press opening 9 after they have passed their relevant discharge unit 50.

Also the embodiment exemplified here assumed the use of a total of five or thirteen filter belts although it is self-evident that any desired number of approximately 1 cm thick layers could be used. It is further self-evident that, for example, 20 layers are possible with relatively low design input.

All the features and advantages of the invention arising from the description, claims and drawings, including design details and spatial configurations, can be characteristic of the invention, both in themselves and in any desired combination.

DRAWING REFERENCE LIST

1=Device
2=Filter cloth
3=Ply
4=Ply
5=Ply
6=Ply
7=Press platen
8=Press crown
9, 9A=Press opening
10=Loading device
11=Filter belt
12=Filter belt
13=Filter belt
14=Filter belt
15=Filter belt
16=Pressure plate (rigid)
17=Pressure plate (movable)
18=Free end of 16
19=Free end of 16
20=Free end of 17
21=Free end of 17
22=High-pressure generator
23=High-pressure generator
24=Frame
25, 25'=Stack
26=Terminal zone
27=Terminal zone
28=Upper strand
29=Lower strand
30=Intermediate plate
31=Press surface of 30
32=Press surface of 30
33=Press surface of 17
34=Press surface of 16
35=Hydraulic cylinder units
36=Cylinder housing
37=
38=Pin
39=Lateral extension of 16
40=Piston rod
41=Lug
42=Pin
43=Lateral extension of 17
44=Lateral extension of 30
45=Bore in 44
46=Driver
47=Plate
48=Filtrate collection reservoir
49=Filtrate collection reservoir
50=Discharge unit
51=Cleaning device
52=Hopper
53=Bucket conveyor
54=Feed chute
55=Upper strand of 53
56=Lower strand of 53
57=Idler
58=Idler
59=Roller
60=Roller
61=Roller
62=Device (thickness of layer)
63=Discharge roller
64=Scraper blade
64', 65=Idler
66=Idler
67=Idler
68=Discharge roller
69=Roller
70=Roller
71=Roller
72=Discharge roller
73=Roller
74=Idler
75=Idler
76=Lateral extension of 94
77=Upper end of 85, 86
78=Lower end of 85, 86
79=Nuts
80=Frame
81=Pressure beam
82=Pressure beam
83=Free end of 81
84=Free end of 82
85=Tension rod
86=Tension rod
87=Movable pressure plate
88=Hydraulic bed
89=Single hydraulic cylinder
90=Drawer
91=Lifting cylinder
92=Second pressure plate
93=Second hydraulic bed
94=Intermediate plate
95=Upper face of 94
96=Press surface
97=Lower face of 94
98=Abutment
99=Idler
100=Idler
101=Brush roll
102=Brush roll
103=Scraper
104=Housing
105=Base of 104
106=Conveyor device 107=Worm conveyor
108=Worm conveyor of 10
109=Housing of 108
110=Material outlet opening
111=Outside of 109
112=Drag ring
113=Feed screw of 108
114=Baffle housing
115=Feed edge
116=Chamber wheel
117=Machine frame
118=Piston rods of 91
119=Bracket
120=Piston rods of 89
121=Lower face of 81
122=Side wall of 90
123=Guides
124=Drag bars

I claim:

1. A device for compressing plant matter comprising:

at least one filter cloth have distributed thereon a thin layer of the plant matter, the filter cloth enclosing the plant matter to form a plurality of superimposed plies;

a loading means for distributing the matter to be pressed in thin layers of approximately 10 mm thickness onto the filter cloth; and a press platen means and a press crown means forming a press with a press opening for applying a substantially high pressure between the plurality of superimposed plies of filter cloth and plant matter, wherein a plurality of filter cloths is provided having distributed thereon each a thin layer of the plant matter, wherein the plurality of superimposed plies include the plurality of filter cloths with the plant matter being enclosed between each two individual filter cloths, wherein the press platen means and the crown means are substantially flat, rectilinear and horizontal, and wherein the superimposed plies formed by the filter cloths and the plant matter are fed rectilinearly and horizontally through the press opening and into the press formed between the press platen means and the crown means to thereby crush the plant matter.

2. The device as claimed in claim 1, wherein each of the plurality of plies is an endless filter belt running intermittently relative to a press cycle, and wherein a loading device is assigned to each filter belt.

3. Device as claimed in claim 2, wherein the filter belts run together in the same direction.

4. Device as claimed in any one of claims 2, 3 or 1, wherein the press platen and the press crown are formed within an enclosed rigid frame, wherein the frame comprises an upper and a lower pressure beam and two tension rods linking the free ends of the pressure beams and maintaining a fixed distance between them, wherein one of the press platen and the press crown is formed by a pressure plate which can move within the frame and wherein the movable pressure plate can be pressurized by high-pressure generators within the enclosed frame.

5. Device as claimed in claim 4, wherein the movable pressure plate is formed as a hydraulic bed where a number of high-pressure generators are provided which are distributed over one of the length and width of the movable pressure plate.

6. Device as claimed in claim 5, wherein the high-pressure generators are located in two contiguous parallel rows on the movable pressure plate.

7. Device as claimed in claim 6, wherein between six and twelve high-pressure generators are provided in each of the parallel rows.

8. Device as claimed in claim 5, wherein the movable pressure plate is in the form of a box-shaped drawer into which the high-pressure generators are inserted.

9. Device as claimed in claim 4, wherein the high-pressure generators are in the form of single hydraulic cylinders.

10. Device as claimed in claim 9, wherein the movable pressure plate is mounted at both ends in lifting cylinders which can be actuated to open the press opening and retract the depressurised high-pressure generators.

11. Device as claimed in any one of claims 2, 3 or 1 wherein the press platen and the press crown are formed by at least one pair of pressure plates, wherein said pair of pressure plates comprises a rigidly mounted pressure plate and an opposed movable pressure plate, between which the stack of filter belts runs with the matter to be pressed contained between the belts, and wherein the pressure plates forming the pair are connected together by high-pressure generators located at their free ends to form an enclosed frame.

12. Device as claimed in claim 11, wherein the press platen and the press crown are formed by a plurality of adjacently located frames.

13. Device as claimed in claim 11, wherein the filter belts forming the stack are tracked between their terminal zones in a rectilinear, horizontal line in two stacks forming an upper strand and a counter-running lower strand of the belt circuit.

14. Device as claimed in claim 13, wherein two press openings are provided, one of which accommodates the stack on the upper strand and the other the stack on the lower strand.

15. Device as claimed in claim 14, wherein a movable intermediate plate is provided between the hydraulic bed forming the movable pressure plate and a second hydraulic bed located vertically beneath this forming a second movable pressure plate wherein the intermediate plate comprises a press surface on its upper face which forms the press platen of the upper press opening, and wherein the lower face of the intermediate plate forms the abutment for the high-pressure generators of the second hydraulic bed.

16. Device as claimed in claim 15, wherein the intermediate plate is provided with bores in two lateral extensions, wherein said bores are located in guides which can be displaced in sliding fashion on the tension rods which connect the upper and lower pressure beams.

17. Device as claimed in claim 14, wherein a movable intermediate plate is provided between the upper movable pressure plate and the lower rigidly mounted pressure plate, wherein said intermediate plate comprises two press surface one of which is located opposite the press surfaces of the upper movable pressure plate and the other opposite the press surfaces of the lower rigidly mounted pressure plate.

18. Device as claimed in claim 17, wherein the intermediate plate is provided with bores in two lateral extensions, wherein said bores are located in guides which can be displaced in sliding fashion on the piston rod and wherein a driver is attached to each piston rod, said driver being located below the bores.

19. Device as claimed in claim 11, wherein the high-pressure generators are in the form of double-action hydraulic cylinder units.

20. Device as claimed in claim 19, wherein the cylinder housing of the hydraulic cylinder units is attached to the lower rigidly mounted pressure plate, and wherein the piston rod of the hydraulic cylinder unit is connected to the upper movable pressure plate.

21. Device as claimed in claim 11, wherein a plate is attached to the press surface.

22. Device as claimed in claim 21, wherein the plates on the sides facing the stacks comprise open filtrate channels.

23. Device as claimed in claim 22, wherein filtrate collection reservoirs are provided under each stack.

24. Device as claimed in claim 11, wherein the filter belts which form the stacks are split into individual tracks via idlers outside the press opening.

25. Device as claimed in claim 24, wherein at least one loading device and at least one discharge unit are provided in each of the tracks for each filter belt.

26. Device as claimed in claim 25, wherein every discharge unit comprises two idlers which run in opposed directions and wherein two opposed filter belts of the stack are separated from each other, wherein a brush roll is provided opposite each idler, wherein each filter belt is fed between an idler and a brush roll, and wherein the brush rolls are driven such that they are counter-rotating relative to their respective idlers.

27. Device as claimed in claim 26, wherein a scraper is located at the idler in direct contact with the crushed matter.

28. Device as claimed in claim 26, wherein the bristles on the brush rolls are made of a material from the group consisting of plastic and steel.

29. Device as claimed in claim 26, wherein the brush rolls are located in a trough-like housing open at the top below the track, and wherein a conveyor device is provided for the crushed matter on the base of the housing.

30. Device as claimed in claim 29, wherein the conveyor device is in the form of a screw conveyor.

31. Device as claimed in claim 25, wherein the loading device is designed to provide a uniform thickness throughout the layer of matter to be pressed.

32. Device as claimed in claim 31, wherein the loading device comprises a screw conveyor which spans the full width of the filter belts, and wherein in the region of the underside of the housing of the screw conveyor a material outlet opening is provided which reaches across the full width of the filter belts.

33. Device as claimed in claim 32, wherein a circulating rotary-driven drag ring is provided on the outside portion of the housing of the screw conveyor, and wherein the direction of rotation of the drag ring is opposed to the direction of rotation of the feed screw of the screw conveyor.

34. Device as claimed in claim 33, wherein the drag ring is provided with a baffle housing which comprises a rectilinear feed edge over the full width of the filter belts.

35. Device as claimed in claim 34, wherein the material outlet opening is offset in the direction rotation of the feed screw relative to the feed edge.

36. Device as claimed in claim 35, wherein a rotary-driven chamber wheel is located behind the feed edge in the running direction of a filter belt.

37. Device as claimed in claim 36, wherein the direction of rotation of the chamber wheel is opposed to the running direction of the corresponding filter belt.

38. Device as claimed in claim 25, wherein the loading devices are formed by a hopper, one of a chain slat conveyor and a bucket conveyor, and a feed chute.

39. Device as claimed in claim 38, wherein at least part of the filter belts is fed outside the press opening between the upper strand and the lower strand of the bucket conveyor.

40. Device as claimed in claim 24, wherein two loading devices and two discharge units are provided in each of the tracks for each filter belt.

41. Device as claimed in claim 24, wherein at least one cleaning device is provided for the filter belts within each track.

* * * * *